US011519114B2

(12) United States Patent
Yokoyama

(10) Patent No.: US 11,519,114 B2
(45) Date of Patent: Dec. 6, 2022

(54) MULTI-NEEDLE SEWING MACHINE

(71) Applicant: BROTHER KOGYO KABUSHIKI KAISHA, Nagoya (JP)

(72) Inventor: Aki Yokoyama, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 107 days.

(21) Appl. No.: 17/184,340

(22) Filed: Feb. 24, 2021

(65) Prior Publication Data

US 2021/0269954 A1 Sep. 2, 2021

(30) Foreign Application Priority Data

Feb. 28, 2020 (JP) ..... JP2020-033784

(51) Int. Cl.

| | |
|---|---|
| ***D05C 13/02*** | (2006.01) |
| ***D05B 55/10*** | (2006.01) |
| ***D05B 55/14*** | (2006.01) |
| ***D05B 69/24*** | (2006.01) |

(52) U.S. Cl.

CPC ..... *D05C 13/02* (2013.01); *D05B 55/10* (2013.01); *D05B 55/14* (2013.01); *D05B 69/24* (2013.01)

(58) Field of Classification Search

CPC . D05C 5/00; D05C 5/02; D05C 13/02; D05B 19/12; D05B 19/16; D05B 55/10; D05B 55/14; D05B 69/24

See application file for complete search history.

(56) References Cited

U.S. PATENT DOCUMENTS

| | | | | |
|---|---|---|---|---|
| 2007/0204779 | A1* | 9/2007 | Naka | D05B 21/00 112/470.04 |
| 2010/0236463 | A1 | 9/2010 | Fujihara et al. | |
| 2011/0041742 | A1* | 2/2011 | Fujihara | D05B 19/12 112/470.01 |
| 2011/0185957 | A1 | 8/2011 | Fukao | |
| 2015/0059631 | A1* | 3/2015 | Katano | D05B 19/12 112/102.5 |

FOREIGN PATENT DOCUMENTS

| | | |
|---|---|---|
| JP | 2010-220694 A | 10/2010 |
| JP | 2011-156147 A | 8/2011 |

* cited by examiner

*Primary Examiner* — Nathan E Durham
(74) *Attorney, Agent, or Firm* — Oliff PLC

(57) ABSTRACT

A multi-needle sewing machine includes a plurality of needle bars, a needle plate, a needle bar case, a needle bar drive mechanism, a needle bar case movement mechanism, a mounting portion, a frame movement mechanism, a processor, and a memory. The memory is configured to store computer-readable instructions that, when executed by the processor, instruct the processor to perform processes. The processes include identification processing of identifying a position of the needle bar case in the arrangement direction, in accordance with detection of a retraction command causing the mounting portion to be moved to a retracted position, setting processing of setting the retracted position of the mounting portion on the basis of the identified position of the needle bar case in the arrangement direction, and movement processing of controlling the frame movement mechanism to move the mounting portion to the set retracted position.

12 Claims, 15 Drawing Sheets

FIG. 11

88

| TYPE OF EMBROIDERY FRAME | | F1 | F2 | ··· |
|---|---|---|---|---|
| SIZE | | L1, W1 | L2, W2 | ··· |
| IMAGING POSITION X COORDINATE | | X1 | X2 | ··· |
| RETRACTION Y COORDINATE | | Y1 | Y2 | ··· |
| DRIVEN NEEDLE BAR NEEDLE BAR NUMBER | 1 | X11 | X21 | ··· |
| | 2 | X12 | X22 | ··· |
| | 3 | X13 | X23 | ··· |
| | 4 | X14 | X24 | ··· |
| | 5 | X15 | X25 | ··· |
| | 6 | X16 | X26 | ··· |
| | 7 | X17 | X27 | ··· |
| | 8 | X18 | X28 | ··· |
| | 9 | X19 | X29 | ··· |
| | 10 | X20 | X30 | ··· |

MULTI-NEEDLE SEWING MACHINE

CROSS-REFERENCE TO RELATED APPLICATION

This application claims priority to Japanese Patent Application No. 2020-033784 filed Feb. 28, 2020, the content of which is hereby incorporated herein by reference in its entirety.

BACKGROUND

The present disclosure relates to a multi-needle sewing machine provided with a plurality of needle bars.

A multi-needle sewing machine of known art is provided with a main body portion, a plurality of needle bars, a needle bar case, a needle plate, a mounting portion, and a movement mechanism. The main body portion supports the needle bar case such that the needle bar case can move in the left-right direction. The needle bar case supports the plurality of needle bars such that the needle bars can move in the up-down direction. The needle plate includes a needle hole through which a sewing needle mounted on the lower end of the needle bar can be inserted. The mounting portion is used to mount an embroidery frame holding a sewing object. The movement mechanism can move the mounting portion to the front and rear, and to the left and right. Of the plurality of needle bars, the multi-needle sewing machine selects a chosen one of the needle bars to be used in sewing, as a driven needle bar, disposes the driven needle bar in a driven position above the needle hole. and performs embroidery sewing using the driven needle bar.

SUMMARY

In order to make easy an operation relating to the embroidery frame attached to the mounting portion, such as a replacement operation of the embroidery frame mounted on the mounting portion, for example, the multi-needle sewing machine of the known art moves the mounting portion to a predetermined retracted position when a retraction command is acquired. The retraction command is acquired, for example, when a command input by a user is detected, or when a predetermined state is detected. Depending on a size and shape of the embroidery frame, even when the multi-needle sewing machine of the known art moves the mounting portion to the retracted position, the needle bar case may be an obstruction, and it may not be possible to easily perform the operation relating to the embroidery frame attached to the mounting portion.

Embodiments of the broad principles derived herein provide a multi-needle sewing machine with which an operation relating to an embroidery frame mounted on a mounting portion can be more easily performed than in known art.

Embodiments provide a multi-needle sewing machine that includes a plurality of needle bars, a needle plate, a needle bar case, a needle bar drive mechanism, a needle bar case movement mechanism, a mounting portion, a frame movement mechanism, a processor, and a memory. The plurality of needle bars are arranged in an arrangement direction intersecting an up-down direction, and on a lower end portion of each of which a sewing needle is mountable. The needle plate includes a needle hole through which the sewing needle is insertable. The needle bar case is configured to support the plurality of needle bars so as to be movable in the up-down direction. The needle bar drive mechanism is configured to drive, of the plurality of needle bars, a driven needle bar up and down, the driven needle bar being disposed in a driven position above the needle hole. The needle bar case movement mechanism is configured to move the needle bar case in the arrangement direction with respect to the needle hole, and dispose a predetermined one of the plurality of needle bars in the driven position. The mounting portion is a portion on which an embroidery frame configured to hold a sewing object is detachably mountable. The frame movement mechanism is configured to move the mounting portion in two directions intersecting the up-down direction. The processor is configured to control the needle bar drive mechanism, the needle bar case movement mechanism, and the frame movement mechanism. The memory is configured to store computer-readable instructions that, when executed by the processor, instruct the processor to perform processes. The processes include identification processing of identifying a position of the needle bar case in the arrangement direction, in accordance with detection of a retraction command causing the mounting portion to be moved to a retracted position, setting processing of setting the retracted position of the mounting portion on the basis of the identified position of the needle bar case in the arrangement direction, and movement processing of controlling the frame movement mechanism to move the mounting portion to the set retracted position.

BRIEF DESCRIPTION OF THE DRAWINGS

Embodiments will be described below in detail with reference to the accompanying drawings in which:

FIG. 11 is an explanatory diagram of a table; and

DETAILED DESCRIPTION

Hereinafter, a multi-needle sewing machine (hereinafter referred to simply as a sewing machine) 1 according to a first embodiment and a second embodiment will be explained in order, with reference to the drawings. A physical configuration of the sewing machine 1 and an embroidery frame 5 that are common to the first embodiment and the second embodiment will be explained with reference to FIG. 1 to FIG. 3. In the following explanation, the upper side, the lower side, the lower left side, the upper right side, the upper left side, and the lower right side of FIG. 1 are, respectively, the upper side, the lower side, the front side, the rear side, the left side, and the right side of the sewing machine 1 and the embroidery frame 5.

Figure 1:
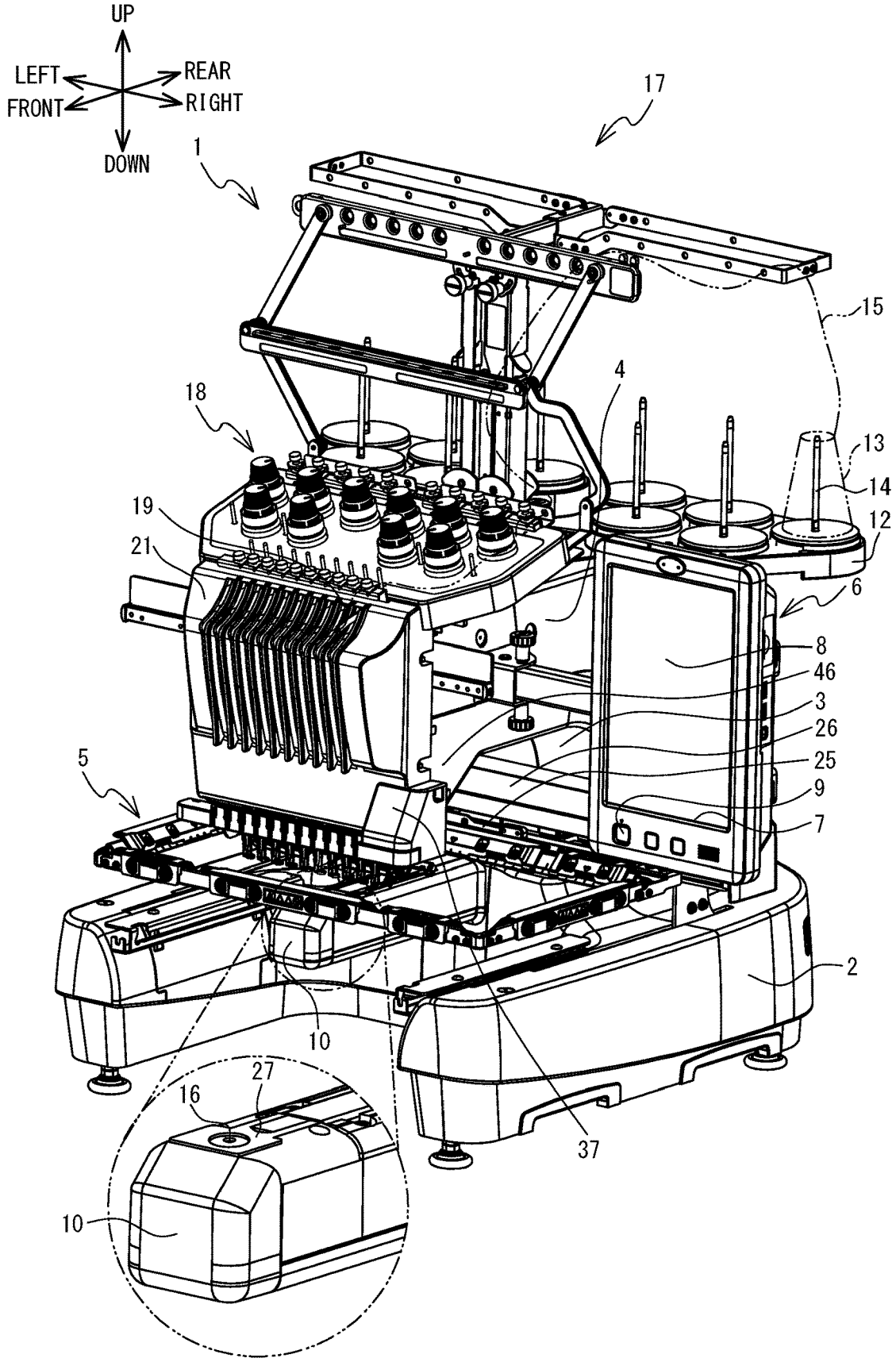
FIG. 1 is a perspective view of a multi-needle sewing machine on which an embroidery frame is mounted.
Figure 2:
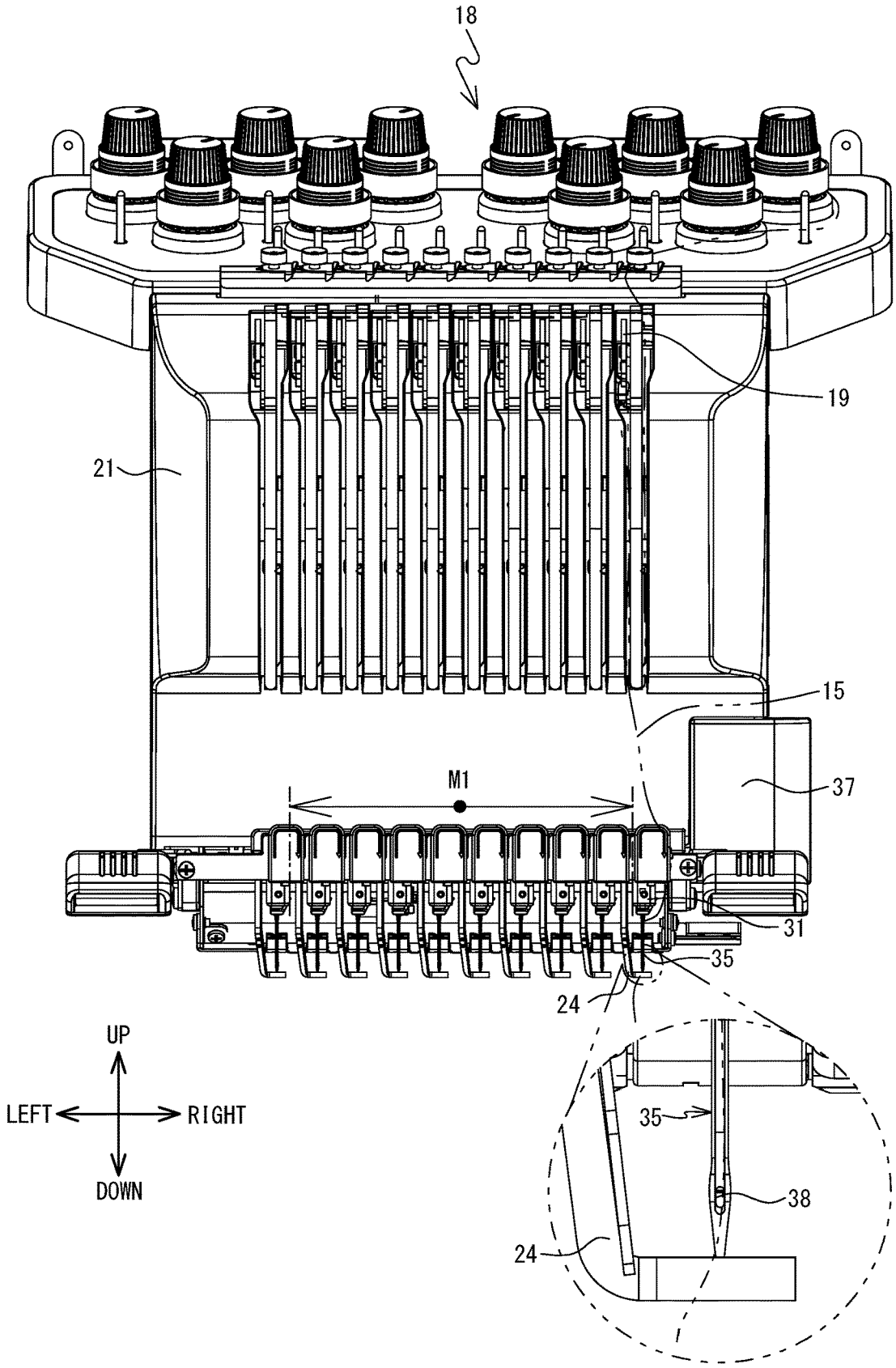
FIG. 2 is a front view of a needle bar case.

As shown in FIG. 1, the sewing machine 1 is provided with a support portion 2, a pillar 3, and an arm portion 4. The support portion 2 supports the sewing machine 1 as a whole. The pillar 3 is provided standing upward from the rear end portion of the support portion 2. The arm portion 4 extends to the front from the upper end portion of the pillar 3. A needle bar case 21 is mounted on a leading end portion 46 of the arm portion 4 such that the needle bar case 21 can move in the left-right direction. As shown in FIG. 2, ten needle bars 31 that extend in the up-down direction are arranged inside the needle bar case 21, at equal intervals in the left-right direction. A needle bar number for identifying the individual needle bars 31 is allocated to each of the needle bars 31. In the present embodiment, the needle bar numbers 1 to 10 are allocated in order from the right side of the sewing machine 1. Of the ten needle bars 31, one of the needle bars 31 that is in a driven position (a driven needle bar 31) is moved up and down by a needle bar drive mechanism 32 (refer to FIG. 4). A sewing needle 35 can be mounted on the lower end of the needle bar 31. A presser foot 24 is mounted on the lower end of a presser bar, and is positioned above a needle plate 27 to be described later. The presser foot 24 can move, together with the presser bar, between a lowered position in which the presser foot 24 presses a sewing object C (refer to FIG. 6), and a raised position in which the presser foot 24 is retracted to a position above the lowered position (separated from the sewing object C). The presser foot 24 operates in concert with the up and down movement of the needle bar 31, and intermittently presses the sewing object C downward. The sewing object C is, for example, a processing cloth. A cover 37 is provided on a lower portion of a right-side surface of the needle bar case 21. An imaging device 39 (refer to FIG. 4) is attached to the inside of the cover 37. The imaging device 39 is a known complementary metal oxide semiconductor (CMOS) image sensor. A lens of the imaging device 39 is oriented to below the cover 37.

As shown in FIG. 1, a cylindrical cylinder head 10 that extends to the front from the lower end portion of the pillar 3 is provided below the arm portion 4. A shuttle (not shown in the drawings) is provided on the inside of the leading end portion of the cylinder head 10. The shuttle houses a bobbin (not shown in the drawings) around which a lower thread (not shown in the drawings) is wound. A shuttle drive mechanism (not shown in the drawings) is provided inside the cylinder head 10. The shuttle drive mechanism rotationally drives the shuttle. The needle plate 27 that is rectangular in a plan view is provided on the upper surface of the cylinder head 10. A needle hole 16, through which the sewing needle 35 (refer to FIG. 2) can be inserted, is provided in the needle plate 27. Of the ten needle bars 31 (refer to FIG. 2), the needle bar 31 positioned in the driven position directly above the needle hole 16 is the driven needle bar 31.

A Y carriage 26 of a movement mechanism 11 (refer to FIG. 4) is provided below the arm portion 4. The movement mechanism 11 is provided with a holder 25, an X motor 132 (refer to FIG. 4), a Y motor 134 (refer to FIG. 4), the Y carriage 26, and an X carriage (not shown in the drawings). One of a plurality of types of embroidery frame, including the embroidery frame 5, can be attached to and detached from the holder 25. The movement mechanism 11 uses the X motor 132 and the Y motor 134 as drive sources, and can move the embroidery frame 5 mounted on the holder 25 to a position indicated by a unique XY coordinate system (an embroidery coordinate system). The X direction and the Y direction of the embroidery coordinate system respectively correspond to the left-right direction and the front-rear direction.

Figure 3:
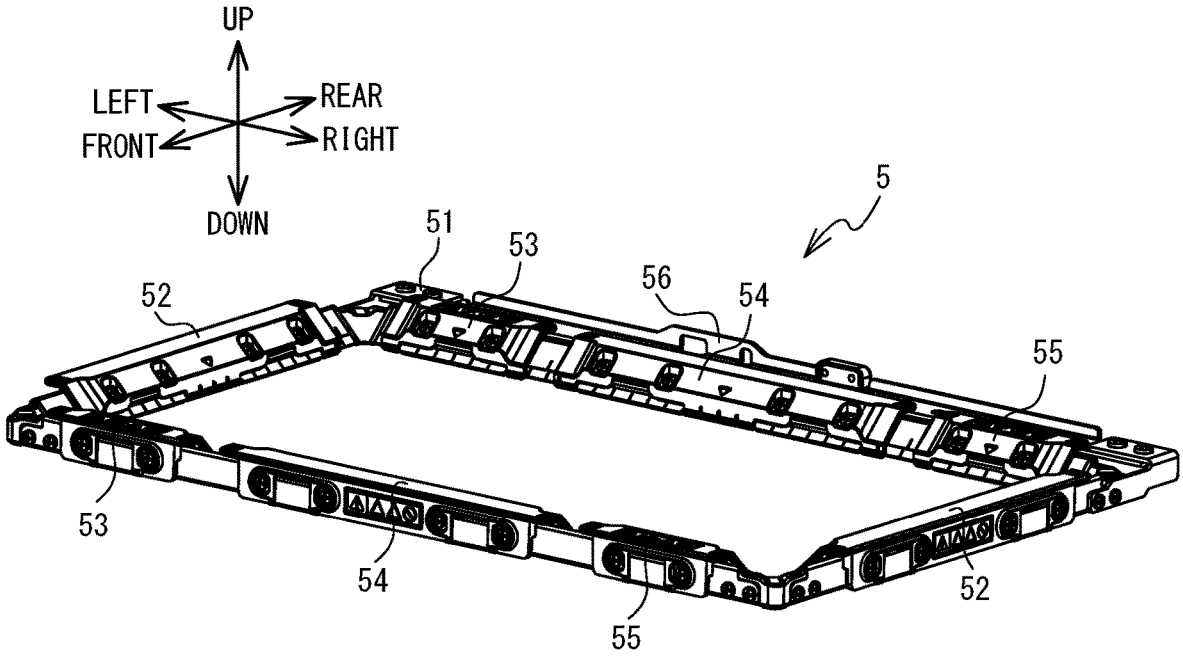
FIG. 3 is a perspective view of the embroidery frame.

As shown in FIG. 3, the embroidery frame 5 is configured to hold the sewing object C. The embroidery frame 5 uses a magnetic force to hold the sewing object C by clamping the sewing object C from above and below with a frame member 51, and a pair of left and right attachment members 52, a pair of front and rear attachment members 53, a pair of front and rear attachment members 54, and a pair of front and rear attachment members 55. The frame member 51 includes a magnetic body in the upper surface of the frame member 51, and is a rectangular frame shape that is long in the left-right direction. The frame member 51 is provided with a mounting portion 56, in the center portion in the left-right direction of the rear side portion. The mounting portion 56 can be mounted on and removed from the holder 25 of the sewing machine 1. The pair of left and right attachment members 52, the pair of front and rear attachment members 53, the pair of front and rear attachment members 54, and the pair of front and rear attachment members 55 respectively include magnets. The pair of left and right attachment members 52 are respectively provided on the left side portion and the right side portion of the frame member 51. The pair of front and rear attachment members 53 are respectively provided on a left-side portion of the front side and a left-side portion of the rear side of the frame member 51. The pair of front and rear attachment members 54 are respectively provided in the center portion of the front side and the center portion of the rear side of the frame member 51. The pair of front and rear attachment members 55 are respectively provided on a right-side portion of the front side and a right-side portion of the rear side of the frame member 51.

As shown in FIG. 1, an operation portion 6 is provided on the arm portion 4. The operation portion 6 is provided with an LCD 7, a touch panel 8, and a start/stop switch 9. The touch panel 8 is provided on a front surface of the LCD 7. The user performs a depression operation on the touch panel 8 using a finger or a stylus pen (hereinafter this operation is referred to as a "panel operation"). In the sewing machine 1, it is recognized which item is selected, depending on a depressed position detected by the touch panel 8. Using the touch panel 8, the user can input a command to execute processing displayed on the LCD 7, select a pattern, set various parameters, and the like. The start/stop switch 9 is used when issuing a command to start or stop the sewing. A pair of left and right thread spool bases 12 are provided on the rear surface side of the upper surface of the arm portion 4. A plurality of thread spool pins 14 are provided on each of the thread spool bases 12. The thread spool pins 14 support thread spools 13. Upper threads 15 are supplied from the thread spools 13 installed on the thread spool bases 12. The upper threads 15 are supplied, via thread paths, to eyes 38 (refer to FIG. 2) of each of the sewing needles 35 mounted on the lower ends of the needle bars 31. The thread path includes a thread guide 17, a tensioner 18, and a thread take-up lever 19.

Figure 4:
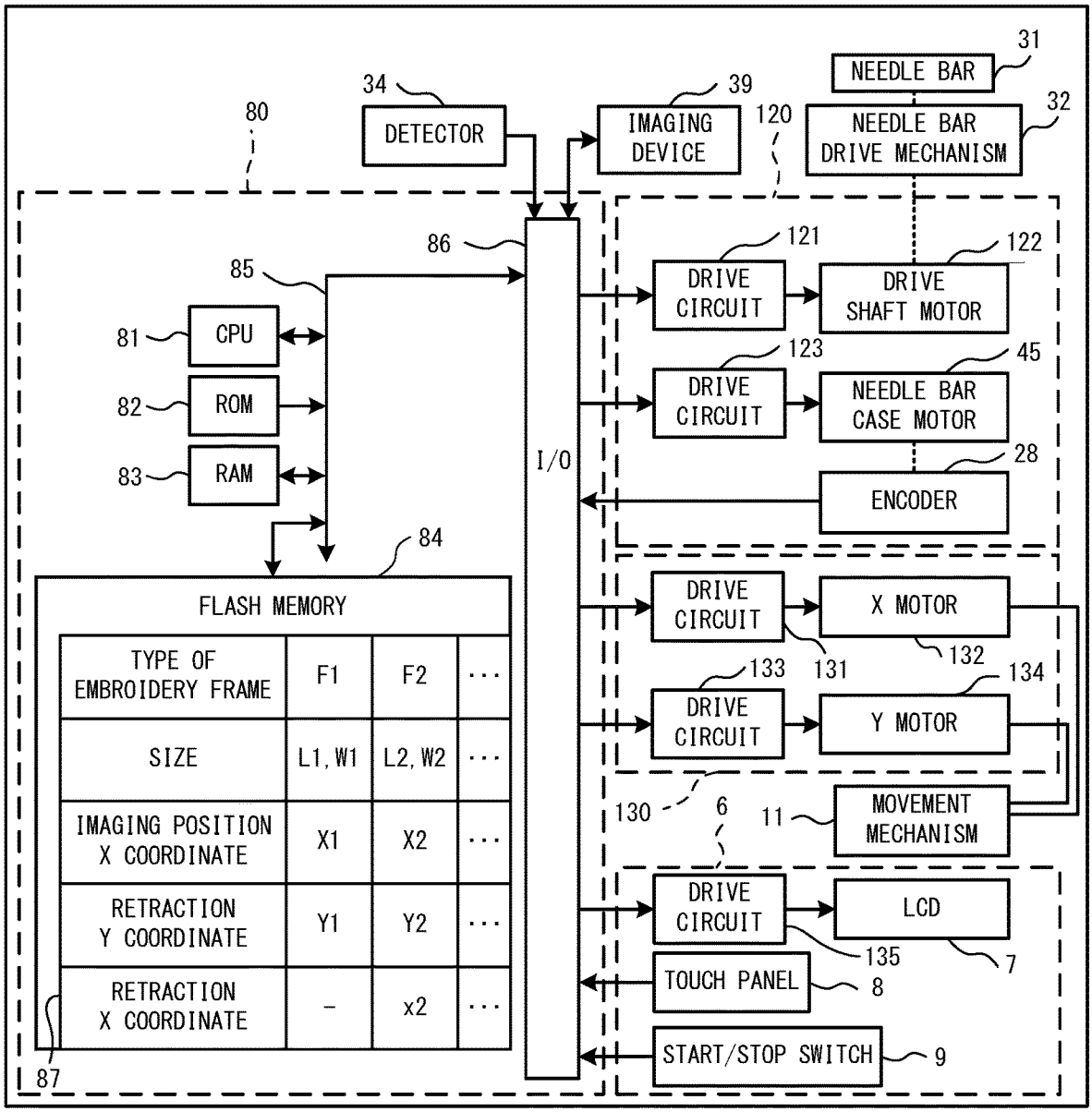
FIG. 4 is a block diagram showing an electrical configuration of the multi-needle sewing machine.

An electrical configuration performing overall control of the sewing machine 1 will be explained with reference to FIG. 4. As shown in FIG. 4, the sewing machine 1 is provided with a detector 34, the imaging device 39, a sewing needle drive portion 120, a sewing object drive portion 130, the operation portion 6, and a control portion 80.

The sewing needle drive portion 120 is provided with drive circuits 121 and 123, a drive shaft motor 122, a needle bar case motor 45, and an encoder 28. The drive shaft motor 122 is configured to drive the needle bar drive mechanism 32, and cause the driven needle bar 31 to reciprocate in the up-down direction. The drive circuit 121 is configured to drive the drive shaft motor 122 in accordance with a control signal from the control portion 80. The needle bar case motor 45 is configured to move the needle bar case 21 in the left-right direction. The drive circuit 123 is configured to drive the needle bar case motor 45 in accordance with a control signal from the control portion 80. The encoder 28 is configured to output, to the control portion 80, a detection result depending on a position of the needle bar case 21 (refer to FIG. 1) with respect to the needle hole 16 (refer to FIG. 1).

The sewing object drive portion 130 is provided with drive circuits 131 and 133, the X motor 132, and the Y motor 134. The X motor 132 is configured to move the holder 25 (refer to FIG. 1) of the movement mechanism 11 in the left-right direction. The drive circuit 131 drives the X motor 132 in accordance with a control signal from the control portion 80. The Y motor 134 is configured to move the holder 25 of the movement mechanism 11 in the front-rear direction. The drive circuit 133 drives the Y motor 134 in accordance with a control signal from the control portion 80. The operation portion 6 is provided with the touch panel 8, a drive circuit 135, the LCD 7, and the start/stop switch 9. The drive circuit 135 drives the LCD 7 in accordance with a control signal from the control portion 80.

The control portion 80 is provided with a CPU 81, a ROM 82, a RAM 83, a flash memory 84, and an input/output interface (I/O) 86, and these members are mutually connected by a bus 85. The detector 34, the imaging device 39, the sewing needle drive portion 120, the sewing object drive portion 130, and the operation portion 6 are further connected to the I/O 86. The CPU 81 is configured to perform overall control of the sewing machine 1. The CPU 81 is configured to execute various arithmetic calculations and processing relating to the sewing, in accordance with various programs stored in a program storage area (not shown in the drawings) of the ROM 82. Although not shown in the drawings, the ROM 82 is provided with a plurality of storage areas, including the program storage area and a pattern storage area. Various programs, including a main program, that cause the sewing machine 1 to operate are stored in the program storage area. The main program is a program for executing main processing to be described later. Embroidery data is stored in the pattern storage area. The RAM 83 is a freely readable and writable storage element. The RAM 83 is provided with storage areas as necessary, to store arithmetic calculation results and the like resulting from the arithmetic processing by the CPU 81. The flash memory 84 is a readable and writable storage element. The flash memory 84 stores various setting values, including a table 87.

The table 87 stores a type of the embroidery frame, a size of the embroidery frame, an imaging position X coordinate, a retraction Y coordinate, and a retraction X coordinate in association with each other. The type of the embroidery frame is information identifying the type of the embroidery frame that can be mounted on the holder 25. The size is an item in which a size of the sewing region set inside the embroidery frame is expressed by a length in the X direction and a length in the Y direction of the embroidery coordinate system. The imaging position X coordinate is an X coordinate of a retracted position expressed by the embroidery coordinate system when the position of the needle bar case 21 in the left-right direction is the imaging position. The retracted position is a position of the holder 25, expressed by the embroidery coordinate system, that is suitable for the user to perform an operation relating to the embroidery frame. The imaging position is a position in which the imaging device 39 is disposed above the needle hole 16. The control portion 80 of the present embodiment causes the imaging device 39 to perform image capture during a period in which the imaging device 39 is positioned in the imaging position above the needle hole 16, and does not cause the imaging device 39 to perform the image capture during a period in which the imaging device 39 is in a position other than the imaging position. The retraction Y coordinate is a Y coordinate of the retracted position expressed by the embroidery coordinate system. The retraction X coordinate is an X coordinate of the retracted position expressed by the embroidery coordinate system. The embroidery frame for which the retraction X coordinate is not stored is an embroidery frame of a particular type for which the retraction X coordinate is set in accordance with the position, in the left-right direction, of the needle bar case 21.

An operation that forms stitches in the sewing object C held by the embroidery frame 5 will be explained with reference to FIG. 1 to FIG. 3. The embroidery frame 5 holding the sewing object C is supported by the holder 25 of the movement mechanism 11. As a result of the needle bar case 21 moving to the left and to the right, one of the ten needle bars 31 is selected as the driven needle bar 31. The embroidery frame 5 is moved to a predetermined position by the movement mechanism 11. The needle bar drive mechanism 32 and a take-up lever drive mechanism drive the selected needle bar 31 and the corresponding take-up lever 19 up and down, using the drive shaft motor 122 (refer to FIG. 4) as a power source. Further, the shuttle drive mechanism rotationally drives the shuttle, using the drive shaft motor 122 as a power source. In this way, the sewing needle 35, the take-up lever 19, and the shuttle move in concert with each other, and the stitches are formed on the sewing object C.

Main processing according to the first embodiment will be explained with reference to FIG. 5 to FIG. 9. The main processing is activated when a power source of the sewing machine 1 is turned ON. In the main processing, in accordance with commands input by the user, the processing is executed to sew an embroidery pattern on the sewing object C held by the embroidery frame 5. The programs that cause each of the processing shown in the flowchart in FIG. 5 to be executed are stored in the ROM 82 shown in FIG. 4, and are executed by the CPU 81.

Figure 5:
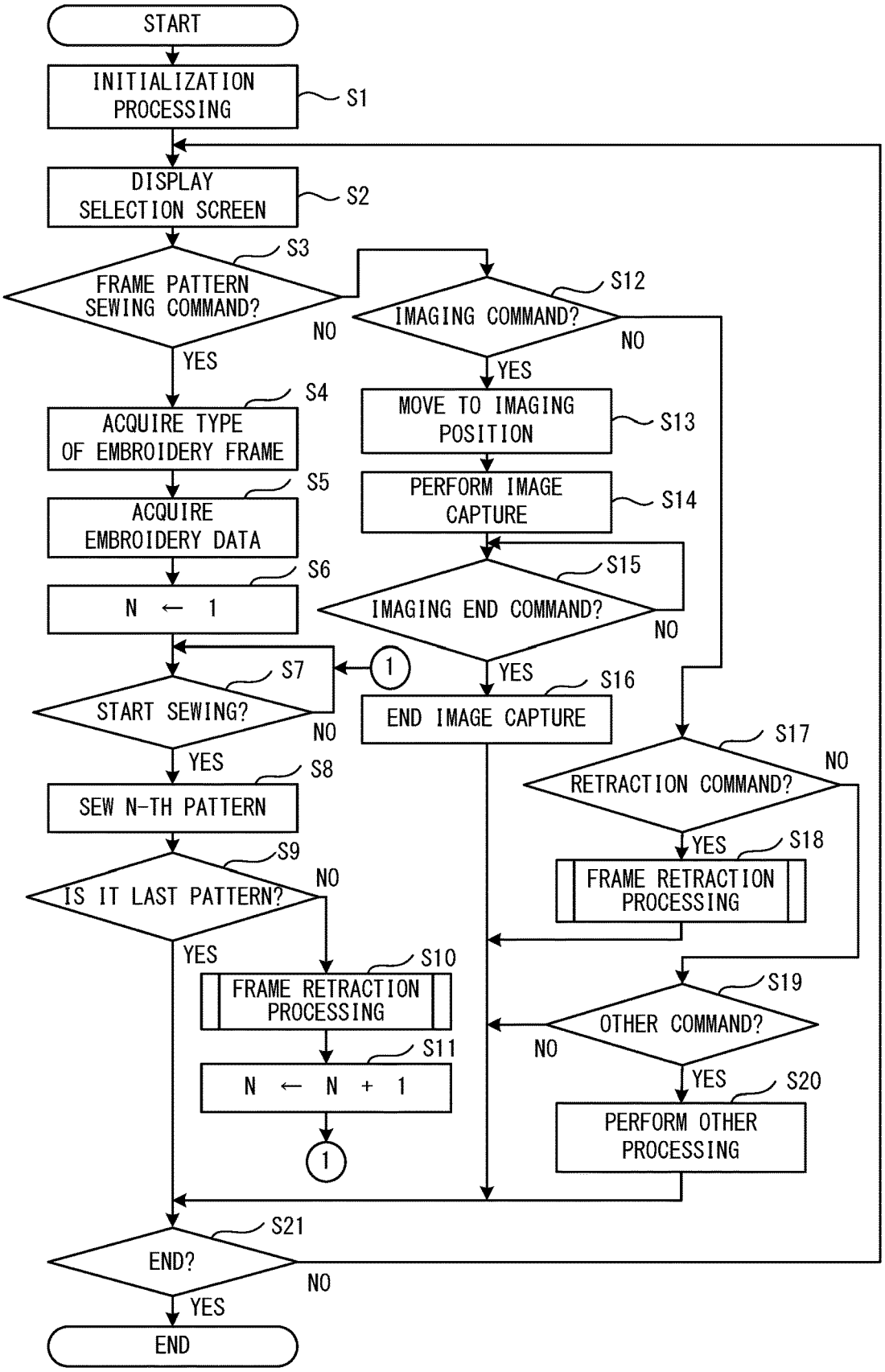
FIG. 5 is a flowchart of main processing.

As shown in FIG. 5, the CPU 81 performs initialization processing (step S1). In the initialization processing, the CPU 81 drives the needle bar case motor 45, for example, and moves the needle bar case 21 to an origin position of the needle bar case 21. The origin position of the needle bar case 21 is, for example, a position at which the needle bar 31 of the needle bar number 1 becomes the driven needle bar 31, and, after moving the needle bar case 21 to the origin position of the needle bar case 21, the CPU 81 sets 1, which is the needle bar number of the driven needle bar 31 in the position of the needle bar case 21 with respect to a reference in an arrangement direction, and stores 1 in the RAM 83. The arrangement direction is a direction in which the plurality of needle bars 31 are arranged, and is the left-right direction in the present embodiment. Of the members provided in the sewing machine 1, the reference is selected as appropriate from among the members that do not move together with the needle bar case 21. The reference of the present embodiment is the needle hole 16. When, for example, the position of the needle bar case 21 with respect to the needle hole 16 is the position in which the needle bar 31 is disposed above the needle hole 16, the CPU 81 identifies the position of the needle bar case 21 with respect to the reference in the arrangement direction by identifying the needle bar number of the driven needle bar 31. The CPU 81 displays a selection screen on the LCD 7 (step S2). The selection screen displays a list of processing that can be executed on the sewing machine 1. The list of the processing includes, for example, sewing processing of a frame pattern, imaging processing, imaging end processing, frame retraction processing, and other processing. The frame pattern is a rectangular frame-shaped embroidery pattern that is applied to rectangular frame-shaped edge portions disposed around an outer periphery of a rectangular-shaped patchwork quilt. Embroidery data for sewing the frame pattern may be stored in advance in a storage device, such as the flash memory 84, may be generated in accordance with the command from the user, or may be acquired from an external device. The imaging processing is processing in which the imaging device 39 is disposed in the imaging position, and an image is captured of the sewing object C held by the embroidery frame 5. The imaging end processing is processing that ends the imaging processing. The frame retraction processing is processing in which the embroidery frame 5 is moved to the retracted position. The CPU 81 of the present embodiment changes a setting method of the retracted position in accordance with the type of the embroidery frame 5. The other processing includes sewing processing of an embroidery pattern other than the frame pattern, for example. The user selects the desired processing from the selection screen displayed at step S2, and inputs a command to execute the selected processing, using the panel operation.

The CPU 81 determines whether a frame pattern sewing command, which starts the sewing processing of the frame pattern, has been detected (step S3). When the frame pattern sewing command has not been detected (no at step S3), the CPU 81 determines whether an imaging command, which starts the imaging processing, has been detected (step S12). When the imaging command has been detected (yes at step S12), the CPU 81 drives the needle bar case motor 45 and moves the needle bar case 21 to the imaging position (step S13). The CPU 81 sets the imaging position as the position of the needle bar case 21 with respect to the reference, and stores the position in the RAM 83. The CPU 81 controls the imaging device 39, and a starts the imaging by the imaging device 39 (step S14). On the basis of image data output from the imaging device 39, the CPU 81 may display an image representing the sewing object C on the LCD 7. After starting the imaging, the CPU 81 determines whether an imaging end command, which executes the imaging end processing, has been detected (step S15). The CPU 81 continues the processing at step S15 until the imaging end command is detected (no at step S15). When the imaging end command has been detected (yes at step S15), the CPU 81 controls the imaging device 39 and ends the imaging processing started at step S14 (step S16). When the imaging command has not been detected (no at step S12), the CPU 81 determines whether a retraction command, which executes the frame retraction processing, has been detected (step S17). When the retraction command has been detected (yes at step S17), the CPU 81 executes the frame retraction processing (step S18).

Figure 7:
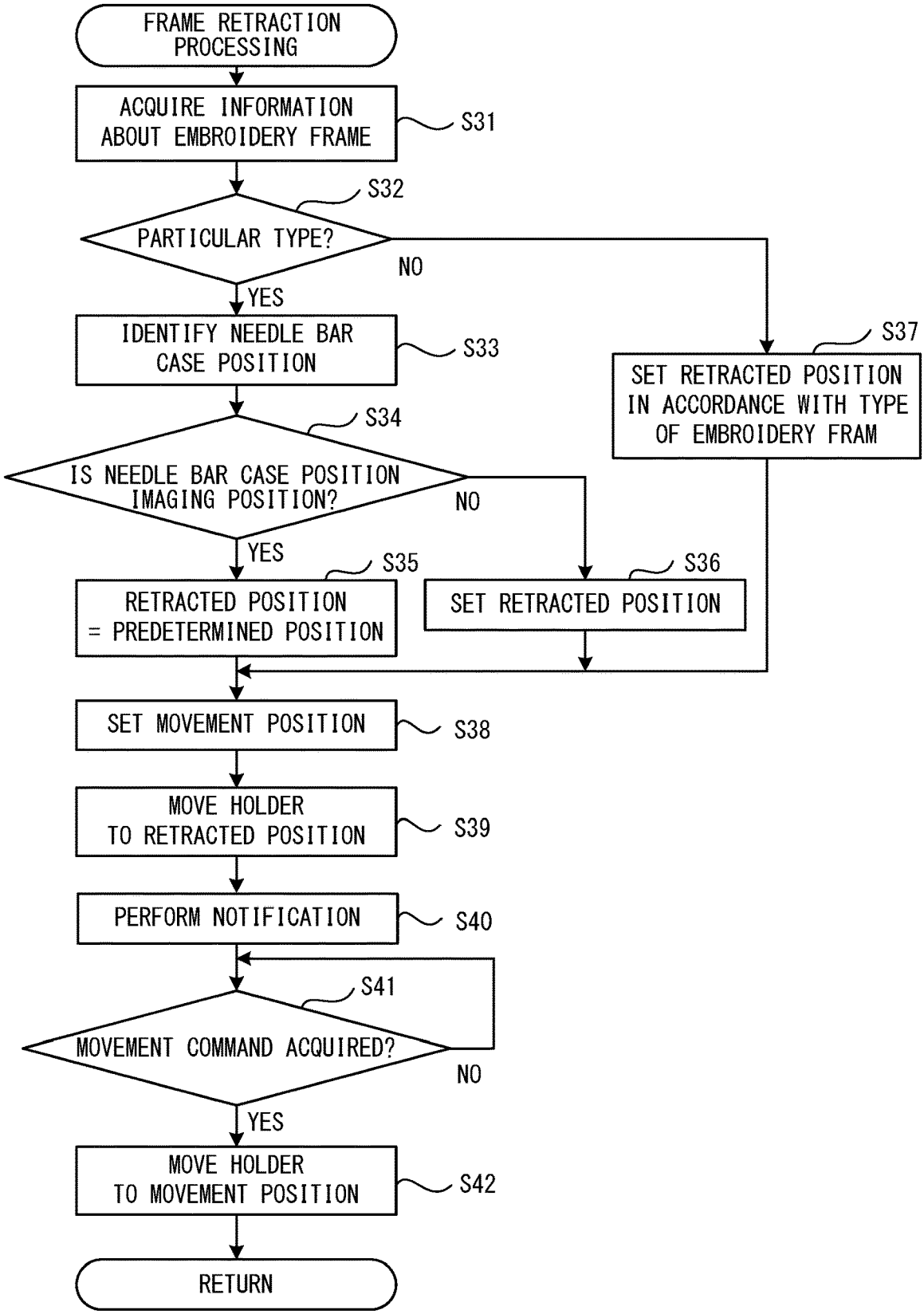
FIG. 7 is a flowchart of frame retraction processing according to a first embodiment that is performed in the main processing shown in FIG. 5.

As shown in FIG. 7, the CPU 81 acquires information about the embroidery frame 5 mounted on the holder 25 (step S31). The information about the embroidery frame 5 mounted on the holder 25 is, for example, at least one of the type of the embroidery frame, the size of the embroidery frame, and the size of the sewing region set on the inside of the embroidery frame. The information about the embroidery frame 5 may be acquired on the basis of the detection result of the detector 34, or may be acquired on the basis of an input result from the user. The information about the embroidery frame according to the first embodiment is the type of the embroidery frame, and, in a specific example, F1 is acquired as the type of the embroidery frame 5. On the basis of the information about the embroidery frame acquired at step S31, the CPU 81 determines whether the embroidery frame is the embroidery frame of the particular type (step S32). For example, the CPU 81 determines that the embroidery frame is the embroidery frame of the particular type when the coordinates are not stored among the retraction X coordinates of the table 87 shown in FIG. 4, and determines that the embroidery frame is not the embroidery frame of the particular type when the retraction X coordinate is stored. For example, when the type of the embroidery frame mounted on the holder 25 is F2, the CPU 81 determines that the embroidery frame mounted on the holder 25 is not the embroidery frame of the particular type (no at step S32), refers to the table 87 of the flash memory 84, sets a position (x2, Y2) corresponding to the type of the embroidery frame acquired at step S31 as the retracted position (step S37), and executes processing at step S38 to be described later.

In the specific example, the CPU 81 determines that the type of the embroidery frame 5 mounted on the holder 25 is F1 and is the embroidery frame of the particular type (yes at step S32), and identifies the position of the needle bar case 21 in the arrangement direction (step S33). The CPU 81 identifies the position of the needle bar case 21 with respect to the reference in the arrangement direction. When the position of the needle bar case 21 with respect to the needle hole 16 is the position in which the imaging device 39 is disposed above the needle hole 16, as the position of the needle bar case 21 with respect to the reference in the arrangement direction, the CPU 81 identifies the imaging position set on the basis of an output of the encoder 28 and stored in the RAM 83 for example.

The CPU 81 determines whether the position of the needle bar case 21 identified at step S33 is the imaging position (step S34). As shown in FIG. 8B, when the position of the needle bar case 21 identified at step S33 is the imaging position (yes at step S34), the CPU 81 sets, as the retracted position, predetermined coordinates (Xl, Y1) at which a holder center M2 is disposed on an arrangement center side with respect to the needle hole 16 (step S35). Of the arrangement direction, the arrangement center side is one side in the arrangement direction, and is, more specifically, a side on which an arrangement center M1 is positioned with respect to the needle hole 16. The arrangement center M1 is a center of an interval between the two needle bars 31 at each of ends, in the arrangement direction, of the plurality of needle bars 31. FIG. 8A to FIG. 8H show a virtual line Z indicating the position of the needle hole 16 in the arrangement direction. In an example shown in FIG. 8B, the arrangement center side is the left side. The predetermined position of the present embodiment is a position aligned, in the arrangement direction, with the arrangement center M1, the holder center M2 and a frame center M3. The X coordinate and the Y coordinate of the predetermined position are, respectively, the imaging position X coordinate and the retraction Y position coordinate stored in the table 87. The holder center M2 is a center of an extension range, in the arrangement direction, of the holder 25. The frame center M3 is a center of an extension range, in the arrangement direction, of the embroidery frame 5 mounted on the holder 25. In the present embodiment, the holder center M2 and the frame center M3 are aligned with each other, but they may be mutually different.

Figure 8A:
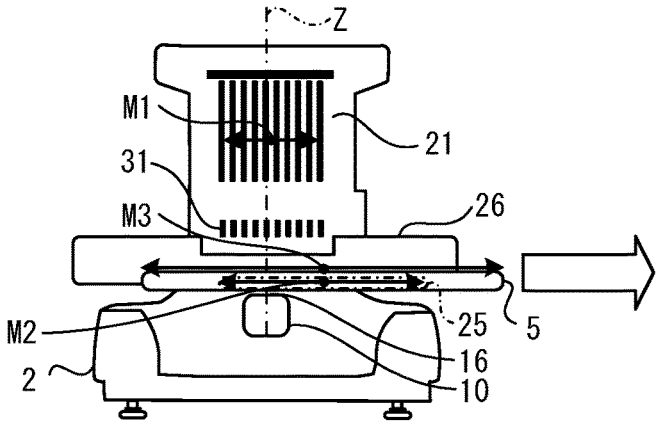
FIG. 8A to FIG. 8H are explanatory diagrams of processing that moves the needle bar case to a retracted position in the frame retraction processing.
Figure 8E:
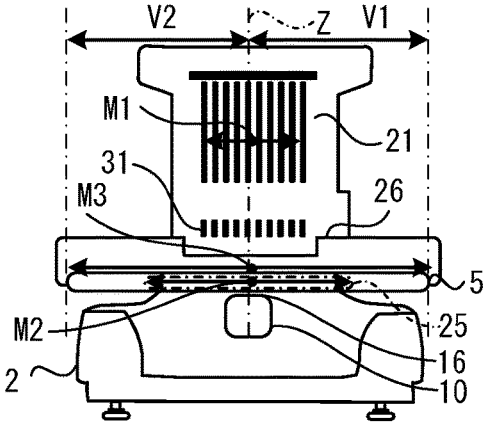
Figure 8B:
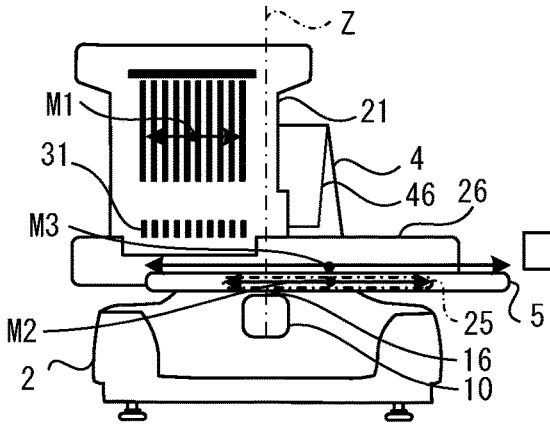
Figure 8F:
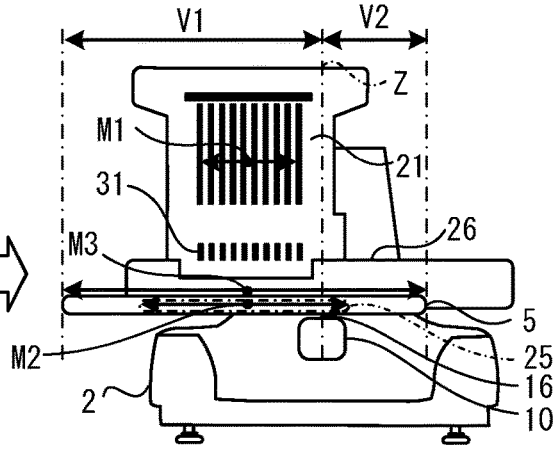
Figure 8C:
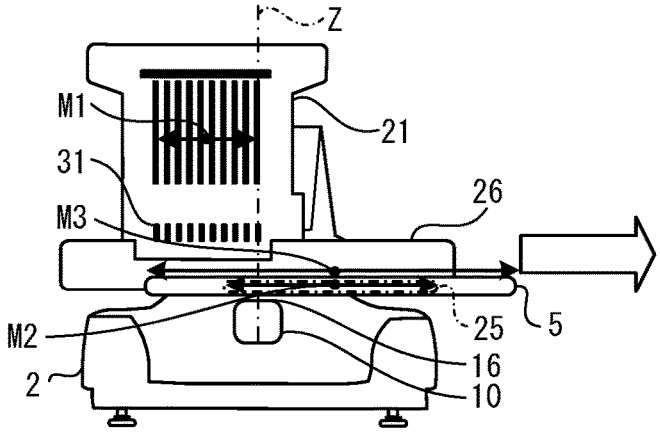
Figure 8G:
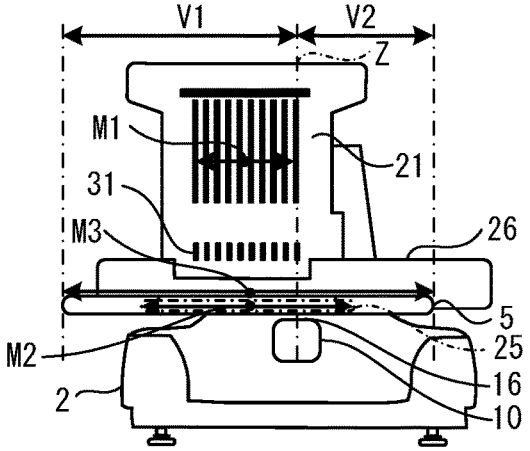
Figure 8D:
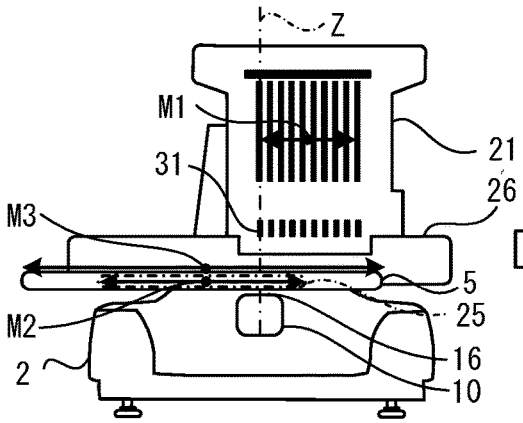
Figure 8H:
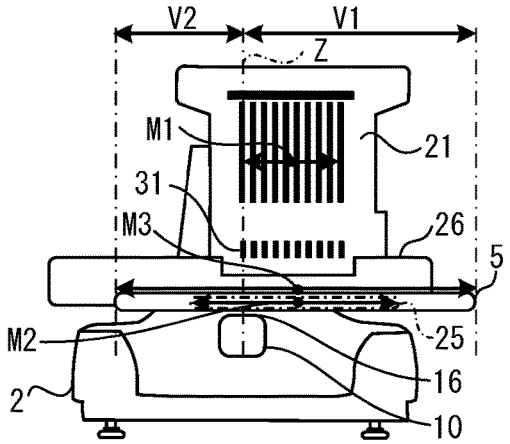
Figure 9:
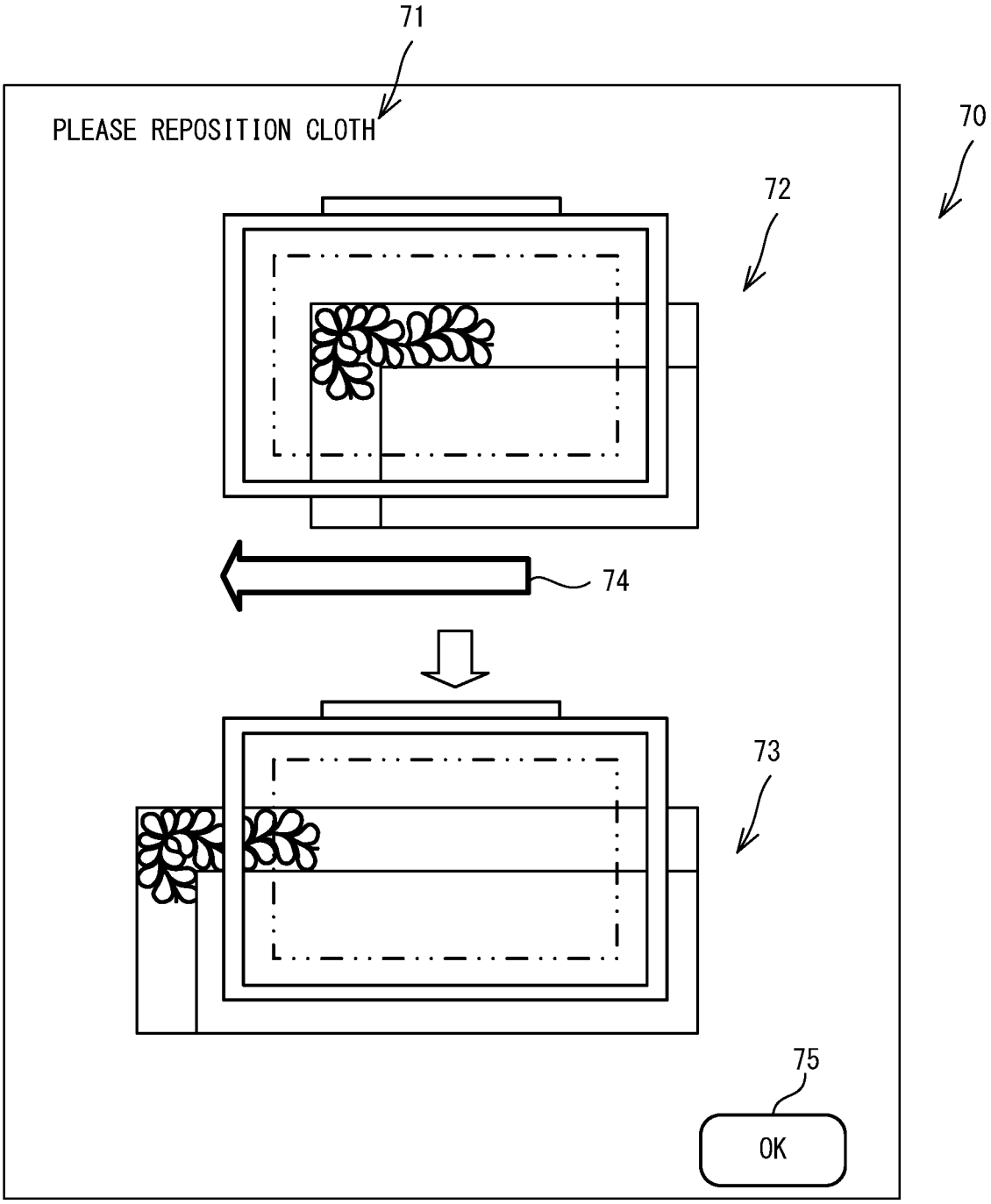
FIG. 9 is an explanatory diagram of a screen.

As shown in FIG. 8A, FIG. 8C, and FIG. 8D, when the position of the needle bar case 21 identified at step S33 is not the imaging position (no at step S34), the CPU 81 sets the retracted position of the holder 25 on the basis of the position of the needle bar case 21 in the arrangement direction identified at step S33 (step S36). The CPU 81 of the present embodiment sets, as the retracted position, a position that satisfies all of the following four conditions. The first condition is that, as the retracted position, a position is set at which the holder center M2, which is the center in the arrangement direction of the holder 25, is disposed on the arrangement center side with respect to the needle hole 16. In the examples shown in FIG. 8A and FIG. 8D, the arrangement center side is the right side. In the example shown in FIG. 8C, the arrangement center side is the left side. The second condition is that, as the retracted position, a position is set at which the holder center M2 is positioned on the arrangement center side with respect to the needle hole 16, and the longer a distance between the needle hole 16 and the arrangement center M1 in the arrangement direction, the longer a distance between the needle hole 16 and the holder center M2 becomes. The third condition is that, as the retracted position, a position is set at which the frame center M3, which is the center in the arrangement direction of the embroidery frame 5 mounted on the holder 25, is disposed on the arrangement center side with respect to the needle hole 16. The fourth condition is that, as the retracted position, a position is set at which an end portion on the arrangement center side of the embroidery frame 5 mounted on the holder 25 is positioned further to the arrangement center side than the needle bar 31 that is furthest to the arrangement center side, of the plurality of needle bars 31. The retracted position is expressed by coordinates of the embroidery coordinate system. The CPU 81 sets the X coordinate of the retracted position by performing a calculation, and sets the Y coordinate of the retracted position corresponding to the type of the embroidery frame by referring to the table 87. When the needle bar number of the driven needle bar 31 identified at step S33 is K, and a constant corresponding to an interval with the adjacent needle bar 31 is C, for example, the CPU 81 sets ((K−5)×C, Y1) as the retracted position. The position expressed by ((K−5)×C, Y1) is a position at which the arrangement center M1, the holder center M2, and the frame center M3 are aligned with each other in the arrangement direction.

The CPU 81 sets a current position of the needle bar case 21 as a movement position, and stores the movement position in the RAM 83 (step S38). The movement position is a position to which the holder 25 is moved, after moving to the retracted position, when a movement command is detected. The movement position is expressed by coordinates of the embroidery coordinate system, for example. The CPU 81 drives the X motor 132 and the Y motor 134, and moves the holder 25 to the retracted position set at step S35, step S36, or step S37 (step S39). In each of the examples shown in FIG. 8A to FIG. 8D, the CPU 81 moves the embroidery frame 5 to the positions shown in FIG. 8E to FIG. 8H, respectively. The retracted positions shown in FIG. 8E to FIG. 8H are mutually different positions. The retracted positions shown in FIG. 8E to FIG. 8H satisfy all of the above-described four conditions. When the embroidery frame 5 is disposed in the retracted positions shown in FIG. 8E to FIG. 8H, the position of the holder center M2 (the frame center M3) in the arrangement direction is not aligned with the position of the needle hole 16 in the arrangement direction, and, in the arrangement direction, a distance V1 between the end portion of the embroidery frame 5 on the arrangement center side (the one side in the arrangement direction) and the needle hole 16 is longer than a distance V2 between the end portion of the embroidery frame 5 on the opposite side to the arrangement center side (another side in the arrangement direction) and the needle hole 16. Similarly, in the retracted position, a distance between the end portion of the holder 25 on the arrangement center side and the needle hole 16 is longer than a distance between the end portion of the holder 25 on the side opposite to the arrangement center side and the needle hole 16.

The CPU 81 performs notification that the processing to move the holder 25 to the retracted position is complete (step S40). For example, the CPU 81 displays a message on the LCD 7 indicating that the processing to move the holder 25 to the retracted position is complete, and prompting the user to perform the operation relating to the embroidery frame 5. The CPU 81 determines whether the movement command has been detected (step S41). When the user moves the holder 25 to the movement position set at step S38, the user inputs the movement command by the panel operation. The CPU 81 continues the processing at step S41 until the movement command is detected (no at step S41). When the movement command is detected (yes at step S41), the CPU 81 drives the X motor 132 and the Y motor 134, and moves the holder 25 to the movement position set at step S38 (step S42). The CPU 81 ends the frame retraction processing here and returns the processing to the main processing at step S5.

When the retraction command has not been detected (no at step S17), the CPU 81 determines whether another command to execute other processing has been detected (step S19). When the other command has been detected (yes at step S19), the CPU 81 executes processing in accordance with the other detected command (step S20). When the other command has not been detected (no at step S19), the CPU 81 determines, or after step S16, step S18, or step S20, whether an end command to end the main processing has been detected (step S21). When the end command has not been detected (no at step S21), the CPU 81 returns the processing to step S2. When the end command has been detected (yes at step S21), the CPU 81 ends the main processing here.

Figure 6:
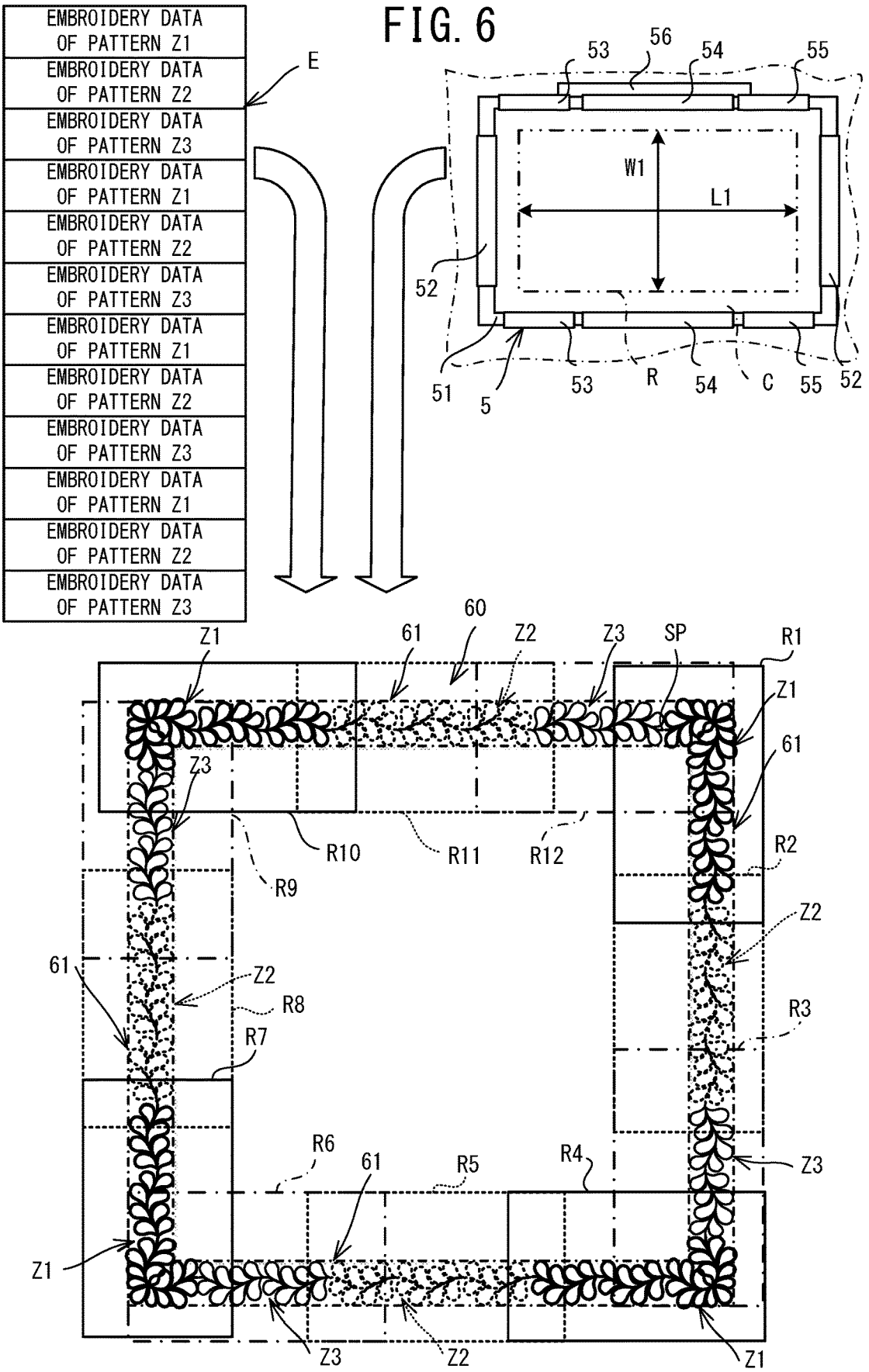
FIG. 6 is an explanatory diagram of embroidery data, a sewing region, and a frame pattern.

When the frame pattern sewing command has been detected (yes at step S3), the CPU 81 acquires the type of the embroidery frame 5 mounted on the holder 25, and a size of a sewing region R set inside the embroidery frame 5 in accordance with the type of the embroidery frame 5 (step S4). The CPU 81 acquires the type of the embroidery frame 5 on the basis of an output value of the detector 34, for example, and acquires the size of the sewing region R on the basis of a correspondence between the acquired type of the embroidery frame 5, the type of the embroidery frame 5 stored in the flash memory 84, and the size of the sewing region R. A method of acquiring the type of the embroidery frame 5 and the size of the sewing region R may be changed as appropriate, and a value input by the user may be acquired, for example. The sewing region R of the embroidery frame 5 shown in FIG. 6 is a rectangular shape having sides extending in the X direction and the Y direction of the embroidery coordinate system, and the size of the sewing region R is expressed by a length L1 in the X direction and a length W1 in the Y direction of the embroidery coordinate system.

The CPU 81 acquires embroidery data for sewing the frame pattern specified by the user (step S5). In the specific example, the CPU 81 acquires embroidery data E for sewing a frame pattern 60. The frame pattern 60 is a rectangular-shaped pattern having four side portions 61, and is a pattern represented by a single continuous line as a whole, in which, in each of the four side portions 61 configuring the frame pattern 60, patterns Z1 to Z3 are joined in order in the clockwise direction in a plan view. The embroidery data E includes embroidery data of the pattern Z1 indicated by thick lines, embroidery data of the pattern Z2 indicated by dotted lines, and embroidery data of the pattern Z3 indicated by thinner lines than the pattern Z1, in a number of sets corresponding to the number of the side portions 61, that is, 4 sets thereof. The frame pattern 60 is larger than the sewing region R, and the patterns Z1 to Z3 are smaller than the sewing region R. With respect to the patterns Z1 to Z3 of each of the side portions 61, the sewing machine 1 sets sewing regions R1 to R12 for which positions of the embroidery frame 5 with respect to the sewing object C are mutually different. The sewing machine 1 sews the frame pattern 60 by taking a point SP of the pattern Z1 on the top right of the frame pattern 60 in FIG. 6 as a sewing start point, and sewing the patterns Z1 to Z3 of each of the side portions 61 in order in the clockwise direction in a plan view.

The CPU 81 sets 1 as a variable N, which is used to read out a sewing order of pattern data included in the embroidery data E (step S6). The CPU 81 determines whether a start command to start sewing the N-th pattern has been detected (step S7). After verifying that the arrangement of the sewing object C with respect to the embroidery frame 5 has been set in a position corresponding to the N-th pattern, the user inputs the start command to start the sewing by operating the start/stop switch 9. The CPU 81 continues the processing at step S7 until the CPU 81 detects the start command (no at step S7). When the start command has been detected (yes at step S7), the CPU 81 drives the sewing needle drive portion 120 and the sewing object drive portion 130, sews the N-th pattern on the sewing object C using, as the driven needle, the needle bar 31 on which the thread of a color specified by the embroidery data is mounted, and drives a thread cutting mechanism (not shown in the drawings) to cut the thread (step S8). The CPU 81 determines whether the N-th pattern is the last pattern in the sewing order sewn in accordance with the embroidery data E acquired at step S5 (step S9). When the N-th pattern is not the last pattern in the sewing order (no at step S9), the CPU 81 executes the frame retraction processing (step S10). In the frame retraction processing at step S10, the CPU 81 takes into account an operation by the user to change the arrangement of the sewing object C with respect to the embroidery frame 5, and executes the processing to move the embroidery frame 5 to the retracted position.

The frame retraction processing executed at step S10 is partially different from the frame retraction processing executed at step S18. As shown in FIG. 7, the CPU 81 acquires the information about the embroidery frame 5 mounted on the holder 25 (step S31). When the information about the embroidery frame 5 has already been acquired at step S4, the processing at step S31 may be omitted as appropriate. On the basis of the information acquired at step S31, the CPU 81 determines whether the embroidery frame 5 is the embroidery frame of the particular type (step S32). The CPU 81 determines that the embroidery frame 5 mounted on the holder 25 is the embroidery frame of the particular type (yes at step S32), and identifies the position of the needle bar case 21 in the arrangement direction (step S33).

As shown in any of FIGS. 8A, 8C, and 8D, when one of the plurality of needle bars 31 is disposed above the needle hole 16, and the position of the needle bar case 21 identified at step S33 is not the imaging position (no at step S34), the CPU 81 sets the position expressed by the coordinates ((K−5)×C, Y1) of the embroidery coordinate system (step S36). In the frame retraction processing executed at step S10, the CPU 81 sets, as the movement position, a sewing start position indicated by the embroidery data of the next pattern in the sewing order, and stores the movement position in the RAM 83 (step S38). The CPU 81 drives the X motor 132 and the Y motor 134, and moves the holder 25 to the retracted position set at step S35, step S36, or step S37 (step S39).

In the frame retraction processing executed at step S10, the CPU 81 displays a message on the LCD 7 prompting the user to change the arrangement of the sewing object C with respect to the embroidery frame 5 (step S40). When the variable N is 1, when the processing at step S10 is executed after sewing the pattern Z1, the CPU 81 displays a screen 70 shown in FIG. 9 on the LCD 7, for example. The screen 70 includes fields 71 to 73, a graphic 74, and a key 75. The field 71 displays the message prompting the user to change the arrangement of the sewing object C with respect to the embroidery frame 5. The field 72 displays a view indicating the arrangement of the sewing object C with respect to the embroidery frame 5 before the arrangement of the sewing object C is changed with respect to the embroidery frame 5. The field 73 displays a view indicating the arrangement of the sewing object C with respect to the embroidery frame 5 after the arrangement of the sewing object C has been changed with respect to the embroidery frame 5. The graphic 74 indicates an arrow of a movement direction of the sewing object C with respect to the embroidery frame 5. After the operation to change the arrangement of the sewing object C with respect to the embroidery frame 5, the key 75 is operated when inputting the movement command to move the embroidery frame 5 to the movement position set at step S38. The user refers to the message displayed on the LCD 7, and performs the operation to change the arrangement of the sewing object C with respect to the embroidery frame 5 using the following procedure, for example. The user removes the attachment members 52 to 54, and slides the sewing object C to the left as indicated by the graphic 74, with the attachment member 55 still attached. In a state in which the user has slid the sewing object C so that the attachment member 55 has moved as far as a position of the attachment member 53 attached to the left side portion of the embroidery frame 5, the user attaches the attachment members 52 to 54 to the frame member 51. In this case, the attachment members 52 and 54 are attached to the frame member 51 in positions at which they were attached before the position of the sewing object C was changed. The attachment member 53 is attached to the frame member 51 in a position at which the attachment member 55 was attached before the position of the sewing object C was changed. Of the patterns Z1 to Z3 sewn on one of the side portions 61 of the frame pattern 60, after the pattern Z3 that is last in the sewing order is sewn, in the frame retraction processing that is executed before sewing the first pattern Z1 that is first in the sewing order of the patterns Z1 to Z3 to be sewn on the next side portion 61 in the sewing order, at step S40, the CPU 81 may display a screen such as described below. The CPU 81 rotates and moves the sewing object C with respect to the embroidery frame 5, and displays a screen on the LCD 7 for changing the arrangement of the sewing object C with respect to the embroidery frame 5. The user refers to the displayed screen, removes the attachment members 52 to 55, rotates and moves the sewing object C, and attaches the attachment members 52 to 55 to the frame member 51.

The CPU 81 determines whether the movement command has been detected (step S41). When causing the holder 25 to be moved to the movement position, the user selects the key 75 by the panel operation, and inputs the movement command. The CPU 81 continues the processing at step S41 until the movement command has been detected (no at step S41). When the movement command has been detected (yes at step S41), the CPU 81 drives the X motor 132 and the Y motor 134, and moves the holder 25 to the movement position set at step S38 (step S42). The CPU 81 ends the frame retraction processing here, and returns the processing to the main processing at step S5. The CPU 81 adds 1 to the variable N (step S11), and returns the processing to step S7. When the N-th pattern is the last pattern in the sewing order (yes at step S9), the CPU 81 determines that the end command has been detected (step S21). When the end command has not been detected (no at step S21), the CPU 81 returns the processing to step S2. When the end command has been detected (yes at step S21), the CPU 81 ends the main processing here.

Figure 10:
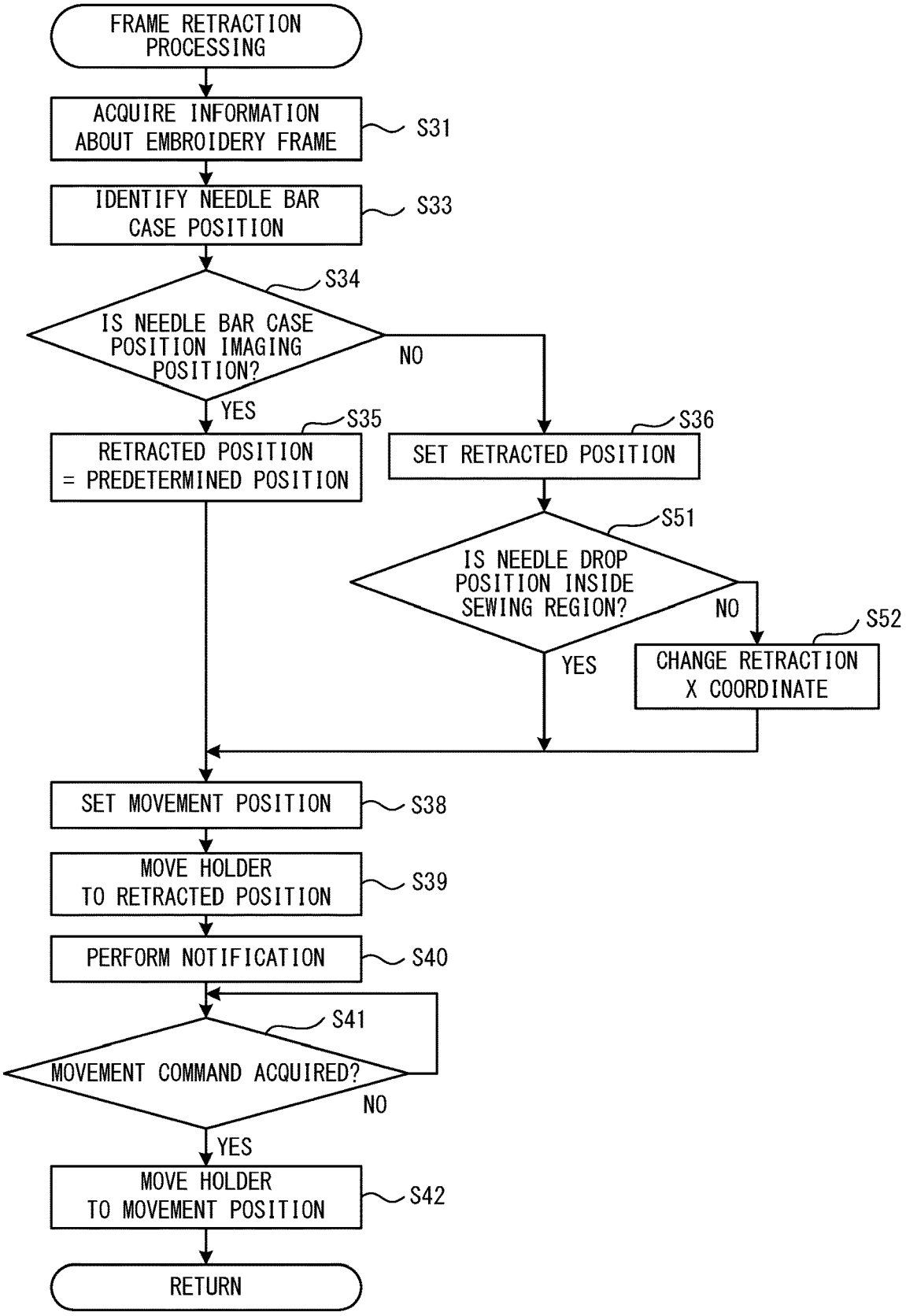
FIG. 10 is a flowchart of the frame retraction processing according to a second embodiment.

The main processing according to a second embodiment will be explained with reference to FIG. 10. In the main processing according to the second embodiment, the frame retraction processing that is executed at step S10 and at step S18 is different from the main processing according to the first embodiment, and the processing other than that at step S10 and step S18 is the same as the main processing according to the first embodiment. In the frame retraction processing according to the second embodiment shown in FIG. 10, the same step numbers are assigned to the processing that is the same as the processing of the frame retraction processing according to the first embodiment shown in FIG. 7. In the frame retraction processing according to the second embodiment, regardless of whether the type of the embroidery frame is the particular type, the retraction X coordinate is calculated by the calculation using the same calculation formula. For the retraction Y coordinate, the coordinate is set in accordance with the type of the embroidery frame. As shown in FIG. 10, the frame retraction processing according to the second embodiment differs from the frame retraction processing according to the first embodiment in that, at step S31, the size of the sewing region R is acquired as the information about the embroidery frame, the processing at step S32 and at step S37 is omitted, and processing at step S51 and step S52 is executed between step S36 and step S38. The processing at step S31, step S33 to step S36, and step S38 to step S42 is the same as that of the first embodiment. An explanation of the processing that is the same as the frame retraction processing according to the first embodiment will be omitted, and the processing that is different from the frame retraction processing according to the first embodiment will be explained. When the holder 25 has been moved to the retracted position set at step S36, at step S51, on the basis of the size of the sewing region R acquired at step S31, the CPU 81 determines whether a needle drop position of the driven needle bar 31 corresponding to the position of the needle bar case 21 in the arrangement direction identified at step S33 is inside the sewing region R (step S51). The needle drop position is a position on the sewing object C at which the sewing needle 35 pierces the sewing object C. The needle drop position can also be described as the position of the embroidery frame 5 with respect to the needle hole 16 in the arrangement direction. When the needle drop position of the driven needle bar 31 is not inside the sewing region R (no at step S51), the CPU 81 changes the retraction X coordinate such that the needle drop position of the driven needle bar 31 when the embroidery frame 5 has been moved to the retracted position is a position contained inside the sewing region R (step S52). For example, the CPU 81 sets the retracted position in the arrangement direction to be a position at which the needle drop position of the driven needle bar 31 is an end portion, on the opposite side to the arrangement center side with respect to the needle hole 16, inside the sewing region R. When the needle drop position of the driven needle bar 31 is inside the sewing region R (yes at step S51), or after the processing at step S52, the CPU 81 executes the processing at step S38 in the same manner as the frame retraction processing according to the first embodiment.

Above, the sewing machine 1 according to the first and second embodiments is provided with the plurality of needle bars 31, the needle plate 27, the needle bar case 21, the needle bar drive mechanism 32, the needle bar case movement mechanism 33, the holder 25, the movement mechanism 11, and the control portion 80. The sewing needle 35 can be mounted on the lower end portion of each of the plurality of needle bars 31, and the needle bars 31 are arranged in the arrangement direction intersecting the up-down direction. The needle plate 27 includes the needle hole 16 through which the sewing needle 35 can be inserted. The needle bar case 21 supports the plurality of needle bars 31 such that they can move up and down. Of the plurality of needle bars 31, the needle bar drive mechanism 32 causes the driven needle bar 31 disposed in the driven position above the needle hole 16 to move up and down. The needle bar case movement mechanism 33 moves the needle bar case 21 in the arrangement direction with respect to the needle hole 16, and disposes the predetermined needle bar 31, of the plurality of needle bars 31, in the driven position. The embroidery frame 5 that is able to hold the sewing object C is detachably mounted on the holder 25. The movement mechanism 11 moves the holder 25 in the front-rear direction and the left-right direction that intersect the up-down direction. The control portion 80 is configured to be able to control the needle bar drive mechanism 32, the needle bar case movement mechanism 33, and the movement mechanism 11. In response to detecting the retraction command that moves the holder 25 to the retracted position, the CPU 81 identifies the position of the needle bar case 21 in the arrangement direction (step S33). The CPU 81 sets the retracted position of the holder 25 (step S35 and step S36) on the basis of the identified position of the needle bar case 21 in the arrangement direction. The CPU 81 controls the movement mechanism 11 and moves the holder to the set retracted position (step S39). Thus, the sewing machine 1 can set the retracted position of the holder 25 on the basis of the position of the needle bar case 21 in the arrangement direction. Compared to a known sewing machine that sets, as the retracted position, a predetermined position regardless of the position of the needle bar case 21 in the arrangement direction, with the sewing machine 1, the operation relating to the embroidery frame 5 mounted on the holder 25 can be easily performed.

At step S35 and step S36, the CPU 81 sets, as the retracted position, a position at which the holder center M2, which is the center in the arrangement direction of the holder 25, is disposed, with respect to the needle hole 16, on the arrangement center side on which the arrangement center M1 of the interval between the two needle bars 31 on both ends, in the arrangement direction, of the plurality of needle bars 31 is positioned with respect to the needle hole 16. Thus, compared to a case in which the holder center M2 is not disposed on the arrangement center side with respect to the needle hole 16, the multi-needle sewing machine 1 can reduce a possibility that the needle bar case 21 obstructs the operation relating to the embroidery frame 5 mounted on the holder 25.

At step S35 and step S36, the CPU 81 sets, as the retracted position, a position at which the holder center M2 is positioned on the arrangement center side with respect to the needle hole 16, and at which, the longer the distance between the needle hole 16 and the arrangement center M1 in the arrangement direction, the longer the distance between the needle hole 16 and the holder center M2 becomes. The sewing machine 1 can set the retracted position while taking into account the distance between the needle hole 16 and the arrangement center M1 in the arrangement direction. Thus, as shown in FIG. 8C and FIG. 8D, even when the needle bar case 21 is at an end portion in a movement range of the needle bar case 21 on the arrangement center side in the arrangement direction, by moving the holder 25 to the retracted position set in accordance with the frame retraction processing, the sewing machine 1 can reduce, in comparison to the known art, the possibility that the needle bar case 21 obstructs the operation relating to the embroidery frame 5 mounted on the holder 25.

At step S35 and step S36, the CPU 81 sets, as the retracted position, a position at which, of the arrangement direction, the frame center M3, which is the center in the arrangement direction of the embroidery frame 5 mounted on the holder 25 is positioned, with respect to the needle hole 16, on the arrangement center side on which the center M1 of the interval between the two needle bars 31 on both the ends, in the arrangement direction, of the plurality of needle bars 31 is positioned with respect to the needle hole 16. On the basis of the position of the needle bar case 21 with respect to the needle hole 16, the sewing machine 1 can set, as the retracted position, the position at which the frame center M3 is disposed, with respect to the needle hole 16, on the arrangement center side with respect to the needle hole 16. Thus, in comparison to the known art, the multi-needle sewing machine 1 can reduce the possibility that the needle bar case 21 obstructs the operation relating to the embroidery frame 5 mounted on the holder 25.

At step S35 and step S36, the CPU 81 sets, as the retracted position, a position at which the end portion on the arrangement center side of the embroidery frame 5 mounted on the holder 25 is positioned further to the arrangement center side than the needle bar 31 that is furthest to the arrangement center side, of the plurality of needle bars 31 in the arrangement direction. The sewing machine 1 can set the retracted position while taking into account the distance in the arrangement direction between the needle hole 16 and the arrangement center M1. Thus, even in a case in which the needle bar case 21 is at the end portion of the arrangement center side in the arrangement direction, in comparison to the known art, the multi-needle sewing machine 1 can reduce the possibility that the needle bar case 21 obstructs the operation relating to the embroidery frame 5 mounted on the holder 25.

The sewing machine 1 is provided with the imaging device 39 that is supported by the needle bar case 21, and that is disposed adjacent to the plurality of needle bars 31 in the arrangement direction. The CPU 81 can dispose the imaging device 39 above the needle hole 16 by controlling the needle bar case movement mechanism 33 (step S13). When the position of the needle bar case 21 with respect to the needle hole 16 identified at step S31 is the imaging position in which the imaging device 39 is disposed above the needle hole 16 (yes at step S34), the CPU 81 sets, as the retracted position, the predetermined position at which the holder center M2 is disposed on the arrangement center side with respect to the needle hole 16 (step S35). Even when the position of the needle bar case 21 with respect to the needle hole 16 identified at step S33 is the imagined above the needle hole 16, the sewing machine 1 can set the retracted position while taking into account the position of the needle bar case 21 with respect to the needle hole 16. In comparison to a case in which the retracted position is set by calculation when the position of the needle bar case 21 with respect to the needle hole 16 identified at step S33 is the imaging position, the sewing machine 1 can simplify the processing to set the retracted position.

The sewing machine 1 according to the second embodiment is provided with the flash memory 84 that stores the correspondence relationship between the type of the embroidery frame 5 and the sewing region R that can be sewn. The CPU 81 acquires the sewing region R corresponding to the embroidery frame 5 mounted on the holder 25 (step S31). When the holder 25 is moved to the retracted position set at step S35 or step S36, the CPU 81 determines whether the needle drop position of the driven needle bar 31 is included in the acquired sewing region R (step S51). When it is determined that the needle drop position of the driven needle bar 31 is not included in the sewing region R (no at step S51), the CPU 81 sets the retracted position to be a position at which the needle drop position of the driven needle bar 31 is the end portion, on the opposite side to the arrangement center side with respect to the needle hole 16, inside the sewing region R (step S52). Thus, the sewing machine 1 can set, as the retracted position, a position at which the needle drop position of the driven needle bar 31 is included inside the sewing region R. Compared to a case in which, as the retracted position, a position is set at which the needle drop position of the driven needle bar 31 is not included inside the sewing region R, the multi-needle sewing machine 1 can reduce a possibility that the driven needle bar 31 damages the embroidery frame 5 at the time of the operation relating to the embroidery frame 5 mounted on the holder 25.

The sewing machine 1 according to the first embodiment and the second embodiment is provided with the operation portion 6 that receives the operation from the user. The retraction command is input via the operation portion 6 (step S17). Thus, when the retraction command is input from the user via the operation portion 6, the sewing machine 1 can move the holder 25 to the retracted position in accordance with the position of the needle bar case 21 with respect to the needle hole 16.

The sewing machine 1 according to the first embodiment and the second embodiment detects, as the retraction command, the information indicating whether, included in the embroidery data for sewing the plurality of patterns, there is the pattern that is to be sewn next (no at step S9), and executes the frame retraction processing (step S10). When the information included in the embroidery data indicating that there is the pattern to be sewn next is read out, the sewing machine 1 can move the holder 25 to the retracted position in accordance with the position of the needle bar case 21 with respect to the needle hole 16. The multi-needle sewing machine 1 can omit the time and effort for the user to input the retraction command to the sewing machine 1 in order to perform the operation to change the position of the sewing object C with respect to the embroidery frame 5.

The sewing machine 1 is provided with the flash memory 84 that stores the correspondence relationship between the type of the embroidery frame 5, and the retracted position in the direction orthogonal to the arrangement direction and the up-down direction. The CPU 81 acquires the type of the embroidery frame 5 mounted on the holder 25 (step S31). The CPU 81 sets the retracted position in the front-rear direction that is orthogonal to the arrangement direction and the up-down direction, in accordance with the type of the embroidery frame 5 acquired at step S31 (step S35 and step S36). The sewing machine 1 can set the retracted position in the front-rear direction that is orthogonal to the arrangement direction and the up-down direction, in accordance with the size of the embroidery frame 5 mounted on the holder 25.

The multi-needle sewing machine according to the present disclosure is not limited to the above-described embodiments, and various modifications may be added insofar as they do not depart from the gist and scope of the present disclosure. For example, the following modifications may be added as appropriate.

(A) The configuration of the sewing machine 1 may be changed as appropriate. The number of the needle bars 31 provided in the sewing machine 1, and the configuration and arrangement of the needle bars 31, may be change as appropriate. The sewing machine 1 need not necessarily be provided with at least one of the imaging device 39 and the operation portion 6, and the shape, arrangement, configuration, and the like thereof may be changed as appropriate. For example, the operation portion 6 may be provided with various switches in addition to the touch panel 8, and a configuration may be adopted in which commands can be input in accordance with operation of the switches.

(B) The program including the commands for executing the main processing shown in FIG. 5 may be stored in a storage device of the sewing machine 1 until the CPU 81 executes the program. Thus, an acquisition method of the program, an acquisition routed, and the device that stores the program may each be changed as appropriate. The program executed by the CPU 81 may be received from another device via a cable or wireless communication, and may be stored in a storage device, such as a flash memory. Examples of the other device include a PC and a server connected via a network.

(C) The respective steps of the main processing executed by the sewing machine 1 are not limited to the example in which they are executed by the control portion 80, and a part or all of the steps may be executed by another electronic device (an ASIC, for example). The respective steps of the main processing may be executed through distributed processing by a plurality of electronic devices (a plurality of CPUs, for example). The respective steps of the main processing can be changed in order, omitted or added, as necessary. An aspect in which an operating system (OS) or the like operating on the sewing machine 1 executes a part or all of the main processing on the basis of a command from the CPU 81 is also included in the cope of the present disclosure. For example, the following modifications (C-1) to (C-4) may be added to the main processing, as appropriate.

(C-1) The sewing machine 1 may calculate the retracted position of the holder 25 by performing the calculation in accordance with the position of the needle bar case 21 in the arrangement direction. The sewing machine 1 may store the retracted position of the holder 25 for each of a plurality of positions in the arrangement direction to which the needle bar case 21 can be moved and may set the retracted position corresponding to the position of the needle bar case 21 identified at step S33, from among the stored retracted positions. In this case, the sewing machine 1 may store a table 88 shown in FIG. 11 in the flash memory 84, in place of the table 87, and at step S33, the CPU 81 may identify the driven needle bar 31 as the position of the needle bar case 21. The table 88 stores the retracted position of the holder 25 for each of the plurality of positions, in the arrangement direction, to which the needle bar case 21 can be moved. The retracted position X coordinate is stored in accordance with the position of the needle bar case 21 indicated by the driven needle bar 31, and the retracted position Y coordinate is stored in accordance with the type of the embroidery frame. The CPU 81 sets, as the retracted position, the position associated with the driven needle bar 31 (step S36). The sewing machine 1 of the present modified example can simplify the processing to set the retracted position, in comparison to a case in which the retracted position is calculated on the basis of the position of the needle bar case 21 with respect to the needle hole 16.

Figure 12A:
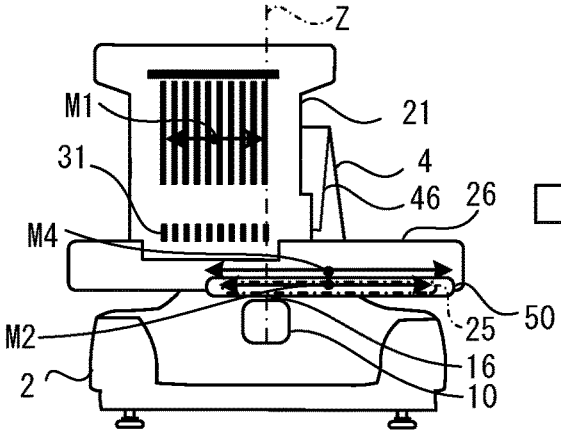
FIG. 12A and FIG. 12B are explanatory diagrams of processing that moves the needle bar case to the retracted position in the frame retraction processing of a modified example.
Figure 12B:
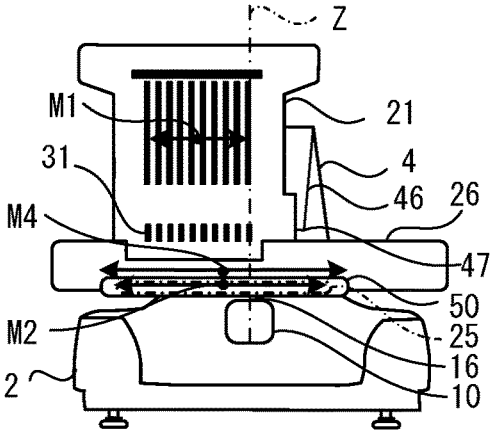

(C-2) The setting method of the retracted position may be changed as appropriate. The retracted position need not necessarily be the position at which the arrangement center M1 and the holder center M2 (the frame center M3) are aligned with each other. The sewing machine 1 may set the retracted position while taking into account a size of the leading end portion 46 of the arm portion 4 supporting the needle bar case 21. The arm portion 4 extends in the front-rear direction orthogonal to the arrangement direction and the up-down direction, internally includes the needle bar case movement mechanism 33 and the needle bar drive mechanism 32, and supports the needle bar case 21 on the leading end portion 46 in the front-rear direction such that the needle bar case 21 can move in the arrangement direction. An embroidery frame 50 whose length in the arrangement direction is shorter than the embroidery frame 5 is mounted on the holder 25. In this case, in the frame retraction processing shown in FIG. 7, the CPU 81 may acquire the size of the embroidery frame 50 mounted on the holder 25 (step S31), and, when the position of the needle bar case 21 is identified as the position at which the needle bar 31 of the needle bar number 1 is the driven needle bar 31, as shown in FIG. 12A (step S33, no at step S34), on the basis of the size of the embroidery frame 50 acquired at step S31, the CPU 81 may set, as the retracted position, the position at which, in the arrangement direction, the end portion on the opposite side to the arrangement center side of the embroidery frame 50 mounted on the holder 25 is positioned further to the opposite side to the arrangement center side than an end portion 47 on the opposite side to the arrangement center side of the leading end portion 46 in the extending direction of the arm portion 4, as shown in FIG. 12B (step S36). In the retracted position shown in FIG. 12B, in the arrangement direction, the holder center M2 and a frame center M4 are on the arrangement center side with respect to the needle hole 16, but the arrangement center M1 is not aligned with the holder center M2 and the frame center M4. In this type of case, the sewing machine 1 can reduce a possibility that the leading end portion 46 in the extending direction of the arm portion 4 obstructs an operation relating to the embroidery frame 50 mounted on the holder 25.

(C-3) The CPU 81 may set the retracted position regardless of the distance in the arrangement direction between the needle hole 16 and the holder center M2, and the distance between the needle hole 16 and the arrangement center M1. For example, when a length of the embroidery frame in the arrangement direction is relatively short relative to a length in the arrangement direction of the lower end portion of the needle bar case 21, if a position at which the frame center M3 and the arrangement center M1 are aligned with each other is set as the retracted position, both the end portions in the arrangement direction of the embroidery frame may be included in an extension range in the arrangement direction of the needle bar case 21. In this type of case, as shown in FIG. 12B, on the basis of the size of the embroidery frame 50 acquired at step S31, the CPU 81 may set, as the retracted position, a position at which the end portion, on the opposite side to the arrangement center side in the arrangement direction, of the embroidery frame 50 mounted on the holder 25 is further to the opposite side to the arrangement center side than the needle bar 31 furthest to the opposite side to the arrangement center side, among the plurality of needle bars 31 (step S36). In this type of case, the sewing machine 1 can set, as the retracted position, a position at which at least the opposite side to the arrangement center side of the embroidery frame 50 in the arrangement direction is easily operated, and can thus reduce, compared to the known art, the possibility of obstructing the operation relating to the embroidery frame 50.

(C-4) The sewing machine 1 may execute only one of step S10 and step S18. The sewing machine 1 may execute the frame retraction processing when a predetermined error is detected, such as cutting of the lower thread. The retracted position in the directions (the Y direction, the front-rear direction) orthogonal to the arrangement direction may be set in accordance with the type of the embroidery frame, or may be set to the same position regardless of the type of the embroidery frame. Alternatively, a current position may be set before moving to the retracted position, or a value that differs depending on the position of the needle bar case 21 may be set. The CPU 81 may set the retracted position of the mounting portion on the basis of the identified position of the needle bar case 21 in the arrangement direction. The CPU 81 may set, as the retracted position, a position satisfying at least one of the above-described four conditions, or may set, as the retracted position, a position satisfying a condition other than the above-described four conditions, on the basis of the position of the needle bar case 21 in the arrangement direction identified at step S33. The CPU 81 may set, as the retracted position, a position that satisfies at least one of the above-described four conditions only when the position of the needle bar case 21 in the arrangement direction satisfies a predetermined condition, and when the position of the needle bar case 21 does not satisfy the predetermined condition, may set a predetermined position in accordance with the type of the embroidery frame, in the same manner as the processing at step S37. The predetermined condition is, for example, when the position of the needle bar case 21 in the arrangement direction identified at step S33 is a position at which the needle bar positioned at the arrangement center M1 and the needle bar 31 adjacent to the arrangement center M1 are not the driven needle bar 31. The CPU 81 may change a setting condition of the retracted position in accordance with conditions executed by the frame retraction processing, or the user may be able to set a condition of the retracted position as appropriate. The CPU 81 may set the retracted position through calculation when the position of the needle bar case 21 in the arrangement direction is the imaging position.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A multi-needle sewing machine comprising:

a plurality of needle bars arranged in an arrangement direction intersecting an up-down direction, and on a lower end portion of each of which a sewing needle is mountable;

a needle plate including a needle hole through which the sewing needle is insertable;

a needle bar case configured to support the plurality of needle bars so as to be movable in the up-down direction;

a needle bar drive mechanism configured to drive, of the plurality of needle bars, a driven needle bar up and down, the driven needle bar being disposed in a driven position above the needle hole;

a needle bar case movement mechanism configured to move the needle bar case in the arrangement direction with respect to the needle hole, and dispose a predetermined one of the plurality of needle bars in the driven position;

a mounting portion on which an embroidery frame configured to hold a sewing object is detachably mountable;

a frame movement mechanism configured to move the mounting portion in two directions intersecting the up-down direction;

a processor configured to control the needle bar drive mechanism, the needle bar case movement mechanism, and the frame movement mechanism; and a memory configured to store computer-readable instructions that, when executed by the processor, instruct the processor to perform processes comprising:

identification processing of identifying a position of the needle bar case in the arrangement direction, in accordance with detection of a retraction command causing the mounting portion to be moved to a retracted position;

setting processing of setting the retracted position of the mounting portion on the basis of the identified position of the needle bar case in the arrangement direction; and movement processing of controlling the frame movement mechanism to move the mounting portion to the set retracted position.

2. The multi-needle sewing machine according to claim 1, wherein the setting processing includes setting, as the retracted position, a position at which a mounting portion center is disposed on an arrangement center side with respect to the needle hole, the arrangement center side being, of the arrangement direction, a side on which a center of an interval between two of the needle bars on both ends, in the arrangement direction, of the plurality of needle bars is positioned with respect to the needle hole, the mounting portion center being a center in the arrangement direction of the mounting portion.

3. The multi-needle sewing machine according to claim 2, wherein the setting processing includes setting, as the retracted position, a position at which the mounting portion center is positioned on the arrangement center side with respect to the needle hole, and at which, in the arrangement direction, the longer a distance between the needle hole and the arrangement center, the longer a distance between the needle hole and the mounting portion center becomes.

4. The multi-needle sewing machine according to claim 2, further comprising:

an arm portion extending in an extending direction orthogonal to the arrangement direction and the up-down direction, internally including the needle bar case movement mechanism and the needle bar drive mechanism, and configured to support the needle bar case to be movable in the arrangement direction, on a leading end portion of the arm portion in the extending direction, wherein the computer-readable instructions further instruct the processor to perform processes comprising:

executing size acquisition processing of acquiring a size of the embroidery frame mounted on the mounting portion, and the setting processing includes setting, as the retracted position, a position at which, on the basis of the size of the embroidery frame acquired in the size acquisition processing, an end portion, in the arrangement direction, on the opposite side to the arrangement center side of the embroidery frame mounted on the mounting portion is further to the opposite side to the arrangement center side than an end portion on the opposite side to the arrangement center side of the leading end portion in the extending direction of the arm portion.

5. The multi-needle sewing machine according to claim 2, further comprising:

an imaging device supported on the needle bar case, and disposed adjacent to the plurality of needle bars in the arrangement direction, wherein the processor is configured to dispose the imaging device above the needle hole by controlling the needle bar case movement mechanism, and when the position of the needle bar case with respect to the needle hole identified in the identification processing is the imaging position at which the imaging device is disposed above the needle hole, the setting processing includes setting, as the retracted position, a predetermined position at which the mounting portion center is disposed on the arrangement center side with respect to the needle hole.

6. The multi-needle sewing machine according to claim 2, wherein the memory further stores a correspondence relationship between the type of the embroidery frame and a sewing region in which sewing is possible, the computer-readable instructions further instruct the processor to perform processes comprising:

region acquisition processing of acquiring the sewing region corresponding to the embroidery frame mounted on the mounting portion; and determination processing of determining whether a needle drop position of the driven needle bar is included in the sewing region, when the mounting portion is moved to the retracted position set in the setting processing, and when the needle drop position of the driven needle bar is not included in the sewing region in the determination processing, the setting processing includes setting the retracted position to a position at which the needle drop position of the driven needle bar is an end portion on an opposite side to the arrangement center side, with respect to the needle hole, of the sewing region.

7. The multi-needle sewing machine according to claim 1, wherein the setting processing includes setting, as the retracted position, a position at which, of the arrangement direction, a frame center is disposed, with respect to the needle hole, on the arrangement center side, on which a center of an interval between two of the needle bars on both of ends, in the arrangement direction, of the plurality of needle bars is positioned with respect to the needle hole, the frame center being the center in the arrangement direction of the embroidery frame mounted on the mounting portion.

8. The multi-needle sewing machine according to claim 7, wherein the setting processing includes setting, as the retracted position, a position at which, in the arrangement direction, an end portion on the arrangement center side of the embroidery frame mounted on the mounting portion is further to the arrangement center side than the needle bar furthest to the arrangement center side, of the plurality of needle bars.

9. The multi-needle sewing machine according to claim 1, wherein the memory further stores the retracted position of the mounting portion for each of a plurality of the positions, in the arrangement direction, to which the needle bar case is movable, and the setting processing includes setting, as the retracted position, a position corresponding to the position of the needle bar case identified in the identification processing, from among the retracted positions stored in the memory.

10. The multi-needle sewing machine according to claim 1, further comprising:

an operation portion configured to receive an operation from a user, wherein the retraction command is input via the operation portion.

11. The multi-needle sewing machine according to claim 1, wherein the retraction command is information indicating that there is a pattern to be sewn next included in embroidery data for sewing a plurality of patterns.

12. The multi-needle sewing machine according to claim 1, wherein the memory further stores a correspondence relationship between the type of the embroidery frame and the retracted position in a direction orthogonal to the arrangement direction and the up-down direction, the computer-readable instructions further instruct the processor to perform processes comprising type acquisition processing of acquiring the type of the embroidery frame mounted on the mounting portion, and the setting processing includes setting the retracted position in the direction orthogonal to the arrangement direction and the up-down direction in accordance with the type of the embroidery frame acquired in the type acquisition processing.

* * * * *